US008869919B2

(12) United States Patent
Shen et al.

(10) Patent No.: US 8,869,919 B2
(45) **Date of Patent: *Oct. 28, 2014**

(54) DRAG BIT WITH UTILITY BLADES

(75) Inventors: Yuelin Shen, Spring, TX (US); Youhe Zhang, Spring, TX (US); Bala Durairajan, Houston, TX (US); Charles H. S. Douglas, III, Flint, TX (US)

(73) Assignee: Smith International, Inc., Houston, TX (US)

( * ) Notice: Subject to any disclaimer, the term of this patent is extended or adjusted under 35 U.S.C. 154(b) by 451 days.

This patent is subject to a terminal disclaimer.

(21) Appl. No.: 13/089,948

(22) Filed: Apr. 19, 2011

(65) Prior Publication Data

US 2011/0253457 A1 Oct. 20, 2011

Related U.S. Application Data

(63) Continuation-in-part of application No. 12/201,516, filed on Aug. 29, 2008, now Pat. No. 7,926,596.

(60) Provisional application No. 60/970,373, filed on Sep. 6, 2007.

(51) Int. Cl.

| | |
|---|---|
| ***E21B 17/10*** | (2006.01) |
| ***E21B 10/00*** | (2006.01) |
| ***E21B 10/42*** | (2006.01) |
| ***E21B 12/02*** | (2006.01) |
| ***E21B 10/43*** | (2006.01) |
| ***E21B 10/60*** | (2006.01) |

(52) U.S. Cl.

CPC ..... *E21B 10/42* (2013.01); *E21B 12/02* (2013.01); *E21B 10/43* (2013.01); *E21B 10/60* (2013.01)

USPC ..... 175/408; 175/325.5; 175/377

(58) Field of Classification Search

USPC ..... 175/393, 408, 331, 377, 325.5

See application file for complete search history.

(56) References Cited

U.S. PATENT DOCUMENTS

| | | | | |
|---|---|---|---|---|
| 3,645,346 | A | 2/1972 | Miller et al. | |
| 4,068,731 | A * | 1/1978 | Garner et al. | 175/339 |
| 4,098,362 | A | 7/1978 | Bonnice | |

(Continued)

FOREIGN PATENT DOCUMENTS

| | | | |
|---|---|---|---|
| EP | 1227214 | | 7/2002 |
| WO | WO 2008097843 | A2 * | 8/2008 |
| WO | 2010115146 | A2 | 10/2010 |

OTHER PUBLICATIONS

Search Report issued by U.K. Intellectual Property Office in corresponding Application No. GB0816298.4, 2 pages.

(Continued)

*Primary Examiner* — Jennifer H Gay
(74) *Attorney, Agent, or Firm* — Osha Liang LLP

(57) ABSTRACT

A drill bit may have a bit body, a plurality of cutting blades extending radially from the bit body and having cutting elements disposed thereon, the plurality of cutting blades forming a cutting blade gage pad diameter configured to contact a formation, and a plurality of raised volumes of material extending from the bit body and devoid of cutting elements, the plurality of raised volumes of material forming a gage pad diameter configured to contact the formation, wherein the plurality of cutting blades and the plurality of raised volume of material are circumferentially spaced having fluid courses that extend therebetween.

23 Claims, 17 Drawing Sheets

(56) References Cited

U.S. PATENT DOCUMENTS

| | | | | |
|---|---|---|---|---|
| 4,253,533 | A | 3/1981 | Baker, III | |
| 4,351,401 | A * | 9/1982 | Fielder | 175/428 |
| 4,467,879 | A | 8/1984 | Burge | |
| 5,010,789 | A | 4/1991 | Brett et al. | |
| 5,163,524 | A | 11/1992 | Newton, Jr. et al. | |
| 5,178,222 | A | 1/1993 | Jones et al. | |
| RE34,435 | E | 11/1993 | Warren et al. | |
| 5,549,171 | A * | 8/1996 | Mensa-Wilmot et al. | 175/431 |
| 5,558,170 | A * | 9/1996 | Thigpen et al. | 175/57 |
| 5,607,024 | A * | 3/1997 | Keith et al. | 175/431 |
| 5,651,421 | A | 7/1997 | Newton et al. | |
| 5,697,461 | A | 12/1997 | Newton et al. | |
| 5,836,404 | A * | 11/1998 | Trujillo et al. | 175/57 |
| 6,006,844 | A | 12/1999 | Van Puymbroeck et al. | |
| 6,006,845 | A * | 12/1999 | Illerhaus et al. | 175/406 |
| 6,112,836 | A * | 9/2000 | Spaar et al. | 175/408 |
| 6,129,161 | A * | 10/2000 | Roberts et al. | 175/393 |
| 6,138,780 | A * | 10/2000 | Beuershausen | 175/408 |
| 6,173,797 | B1 * | 1/2001 | Dykstra et al. | 175/374 |
| 6,290,007 | B2 * | 9/2001 | Beuershausen et al. | 175/408 |
| 6,321,862 | B1 * | 11/2001 | Beuershausen et al. | 175/406 |
| 6,349,780 | B1 * | 2/2002 | Beuershausen | 175/408 |
| 6,484,825 | B2 | 11/2002 | Watson et al. | |
| 6,564,886 | B1 * | 5/2003 | Mensa-Wilmot et al. | 175/331 |
| 6,684,967 | B2 * | 2/2004 | Mensa-Wilmot et al. | 175/408 |
| 7,083,010 | B2 | 8/2006 | Eppink et al. | |
| 7,117,960 | B2 * | 10/2006 | Wheeler et al. | 175/171 |
| 7,308,955 | B2 * | 12/2007 | Barton et al. | 175/325.5 |
| 7,325,632 | B2 * | 2/2008 | Larsen et al. | 175/339 |
| 7,926,596 | B2 * | 4/2011 | Shen et al. | 175/408 |
| 8,087,479 | B2 * | 1/2012 | Kulkarni et al. | 175/73 |
| 8,172,010 | B2 * | 5/2012 | Strachan | 175/391 |
| 8,393,417 | B2 * | 3/2013 | Earles et al. | 175/324 |
| 8,439,136 | B2 * | 5/2013 | Jones et al. | 175/431 |
| 2001/0000885 | A1 * | 5/2001 | Beuershausen et al. | 175/408 |
| 2002/0079139 | A1 * | 6/2002 | Mensa-Wilmot et al. | 175/408 |
| 2003/0111273 | A1 * | 6/2003 | Richert et al. | 175/426 |
| 2006/0048973 | A1 | 3/2006 | Brackin et al. | |
| 2006/0102389 | A1 | 5/2006 | Wiseman et al. | |
| 2006/0260845 | A1 | 11/2006 | Johnson | |
| 2006/0278436 | A1 * | 12/2006 | Dykstra et al. | 175/57 |
| 2007/0151770 | A1 * | 7/2007 | Ganz | 175/426 |
| 2007/0261890 | A1 * | 11/2007 | Cisneros | 175/331 |
| 2007/0272442 | A1 * | 11/2007 | Pastusek et al. | 175/40 |
| 2008/0060848 | A1 * | 3/2008 | Pastusek et al. | 175/40 |
| 2008/0066959 | A1 * | 3/2008 | Pastusek et al. | 175/39 |
| 2009/0065263 | A1 * | 3/2009 | Shen et al. | 175/393 |
| 2009/0145663 | A1 * | 6/2009 | Durairajan et al. | 175/57 |
| 2009/0145669 | A1 * | 6/2009 | Durairajan et al. | 175/431 |
| 2009/0194332 | A1 * | 8/2009 | Pastusek et al. | 175/40 |
| 2009/0321139 | A1 * | 12/2009 | Strachan | 175/61 |
| 2010/0051292 | A1 * | 3/2010 | Trinh et al. | 166/378 |
| 2010/0300761 | A1 * | 12/2010 | Earles et al. | 175/76 |
| 2011/0000714 | A1 * | 1/2011 | Durairajan et al. | 175/57 |
| 2011/0147089 | A1 * | 6/2011 | Kulkarni et al. | 175/73 |
| 2011/0253454 | A1 * | 10/2011 | Freeman | 175/72 |
| 2011/0253457 | A1 * | 10/2011 | Shen et al. | 175/397 |

OTHER PUBLICATIONS

"Field Testing of Low-Friction-Gauge PDC Bits"; L.A. Sinor, J.F. Brett, T.M. Warren, and S.M. Behr; Amoco Production Co.; SPE20416; SPE Drilling & Completion; Mar. 1993; pp. 21-27 (7 pages).

"Flexible Bit: A New Anti-Vibration PDC Bit Concept"; P. Defourny, F. Abbassian; Society of Petroleum Engineers, Inc.; SPE30475; SPE Annual Technical Conference & Exhibition, Dallas, Texas, Oct. 22-25, 1995; pp. 263-275 (13pages).

"Drillstring Stability Based on Variable Material Specific Force and Using a Sharp Three-Insert Polycrystalline Diamond Compact (PDC) Coring Bit"; M. A. Elsayed, L. F. Washington; Journal of Energy Resources Technology, Jun. 2001, vol. 123; pp. 138-143 (6 pages).

Improved Bit Stability Reduces Downhole Harmonics (Vibrations); B. Ortiz, C. Casallas, and H. Parra; International Association of Drilling Contractors/Society of Petroleum Engineers Inc.; IADC/SPE 36413; Asia Pacific Drilling Technology Conference & Exhibition, Kuala Lumpur, Malaysia, Sep. 9-11, 1996; pp. 379-389 (11 pages).

"Development of an Antiwhirl Core Bit"; L.A. Sinor, T.M. Warren, and W.K. Armagost; SPE Drilling & Completion, Sep. 1995; pp. 170-177 (8 pages).

"Innovative Cutting Structure Improves Stability and Penetration Rate of PDC Bits Without Sacrificing Durability"; G. Mensa-Wilmot, T. Krepp; SPE/IADC 39310; IADC/SPE Drilling Conference, Dallas, Texas Mar. 3-6, 1998; pp. 167-175 (9 pages).

"A New Method of Producing Laterally Stable PDC Drill Bits"; S. Johnson, ReedHycalog; IADC/SPE 98986; IADC/SPE Drilling Conference Miami, Florida, Feb. 21-23, 2006; pp. 1-15 (15 pages).

"Innovative Design Processess and Technologies Improve PDC Bit Performance in Harsh Drilling Environments"; G. Mensa-Wilmot, B. Mikhail, M. Al-Saeedi, M. Sounderrajan, D. Al-Enezi, and M. Al-Khaldi; IADC/SPE 103983; IADC/SPE Asia Pacific Drilling Technology Conference and Exhibition, Bangkok, Thailand, Nov. 13-15, 2006; pp. 1-14 (14 pages).

Examination Report issued in related British Patent Application No. GB0816298.4; Dated Sep. 27, 2011 (2 pages).

* cited by examiner

DRAG BIT WITH UTILITY BLADES

CROSS REFERENCE TO RELATED APPLICATIONS

This application is a continuation-in-part of U.S. patent application Ser. No. 12/201,516, filed on Aug. 29, 2008, which claims the priority of a provisional application under 35 U.S.C. §119(e), namely U.S. Patent Application Ser. No. 60/970,373 filed on Sep. 6, 2007, which are both incorporated by reference in their entirety herein.

BACKGROUND OF INVENTION

1. Field of the Invention

Embodiments disclosed herein relate generally to drill bits having enhanced stability. More particularly, embodiments disclosed herein relate to drill bits having stabilization features included thereon.

2. Background Art

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit. Rotary bit durability is, in part, measured by a bit's ability to "hold gage," meaning its ability to maintain a full gage borehole diameter over the entire length of the borehole.

Rotary drill bits with no moving elements are typically referred to as "drag" bits. Drag bits are often used to drill very hard or abrasive formations. Drag bits include those having cutting elements attached to the bit body, such as polycrystalline diamond compact (PDC) bits, and those including abrasive material, such as diamond, impregnated into the surface of the material which forms the bit body. The latter bits are commonly referred to as "impreg" bits. Cutting elements attached to a PDC bit may be disposed on several blades extending from the bit body and are typically formed of extremely hard materials. For example, in a typical PDC bit, cutting elements have a cutting layer (i.e., "working surface") supported by a substrate (used to attach the cutting layer to the bit), wherein a cutting layer may be formed of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate) as well as mixtures or combinations of these materials. For convenience, as used herein, reference to a "PDC bit" refers to a fixed cutter drill bit having cutting elements formed of a layer of polycrystalline diamond or other superabrasive material such as cubic boron nitride, thermally stable diamond, polycrystalline cubic boron nitride, or ultrahard tungsten carbide.

An example of a prior art drag bit having a plurality of cutters with ultra hard working surfaces is shown in FIG. 1. The drill bit 10 includes a bit body 12 and a plurality of blades 14 extending radially from the bit body 12. The blades 14 are separated by channels or gaps 16 that enable drilling fluid to flow between and both clean and cool the blades 14 and cutters 18. Cutters 18 are held in the blades 14 at predetermined angular orientations and radial locations to present working surfaces 20 with a desired back rake angle against a formation to be drilled. Typically, the working surfaces 20 are generally perpendicular to the axis 19 and side surface 21 of a cylindrical cutter 18. Thus, the working surface 20 and the side surface 21 meet or intersect to form a circumferential cutting edge 22.

Orifices are typically formed in the drill bit body 12 and positioned in the gaps 16. The orifices are commonly adapted to accept nozzles 23. The orifices allow drilling fluid to be discharged through the bit in selected directions and at selected rates of flow between the cutting blades 14 for lubricating and cooling the drill bit 10, the blades 14 and the cutters 18. The drilling fluid also cleans and removes the cuttings as the drill bit rotates and penetrates the geological formation. Without proper flow characteristics, insufficient cooling of the cutters may result in cutter failure during drilling operations. The gaps 16, which may be referred to as "fluid courses," are positioned to provide additional flow channels for drilling fluid and to provide a passage for formation cuttings to travel past the drill bit 10 toward the surface of a wellbore (not shown).

The drill bit 10 includes a shank 24 and a crown 26. Shank 24 is typically formed of steel or a matrix material and includes a threaded pin 28 for attachment to a drill string. Crown 26 has a cutting face 30 and outer side surface 32. The particular materials used to form drill bit bodies are selected to provide adequate strength and toughness, while providing good resistance to abrasive and erosive wear.

The combined plurality of surfaces 20 of the cutters 18 effectively forms the cutting face 30 of the drill bit 10. Once the crown 26 is formed, the cutters 18 are positioned in the cutter pockets 34 and affixed by any suitable method, such as brazing, adhesive, mechanical means such as interference fit, or the like. The design depicted provides the cutter pockets 34 inclined with respect to the surface of the crown 26. The cutter pockets 34 are inclined such that cutters 18 are oriented with the working face 20 at a desired rake angle in the direction of rotation of the bit 10, so as to enhance cutting. It will be understood that in an alternative construction (not shown), the cutters can each be substantially perpendicular to the surface of the crown, while an ultra hard surface is affixed to a substrate at an angle on a cutter body or a stud so that a desired rake angle is achieved at the working surface.

The use of PDC bits over roller cone bits has grown over the years, largely as a result of greater rates of penetration (ROPs) frequently attainable using a PDC bit. ROP is a major issue in deep wells. Low ROP (for example, 3 to 5 feet per hour) is primarily a result of a high compressive strength of highly overburdened formations encountered at greater depths. Initially, roller cone bits with hardened inserts used for drilling hard formations at shallower depths were applied as wells went deeper. However, at greater depths it is more difficult to recognize when roller cone bit bearings have failed, a situation that can occur with greater frequency when greater weight is applied to the bit in a deep well. This can lead to more frequent failures, lost cones, more frequent trips, higher costs, and lower overall rates of penetration. PDC bits, having no moving parts, provide a solution to some of the problems experienced with roller cone bits.

However, PDC bits are not without their own inherent problems. "Bit whirl" is a problem that may occur when a PDC bit's center of rotation shifts away from its geometric center, producing a non-cylindrical hole. This may result from an unbalanced condition brought on by irregularities in the frictional forces between the rock and the bit, analogous to an unbalanced tire causing vibrations that spread throughout a car at higher speeds. Bit whirl may cause cutters to be accelerated sideways and backwards, causing chipping that may accelerate bit wear, reduce PDC bit life and reduce rate of penetration (ROP). In addition, bit whirl may result in very high downhole lateral acceleration, which causes damage not only to the bit but also other components in the BHA, such as motors, MWD tools and rotary steerable tools. Bit whirl is well documented as a major cause of damage to PDC drill bits, resulting in short runs, low ROP, high cost per foot, poor hole quality and downhole tool damage. Hence, consistent lateral stability may be highly desirable in PDC bits.

PDC bits may also be more susceptible to this phenomenon as well as to "stick slip" problems, where the bit hangs up momentarily, allowing its rotation to briefly stop, and then slips free at a high speed. While PDC cutters are very good at shearing rock, they may be susceptible to damage from the sharp impacts that these problems can lead to in hard rocks, resulting in reduced bit life and lower overall rates of penetration.

Many approaches have been devised to improve drill bit dynamic characteristics to reduce the detrimental effects to the drill bit. In particular, stabilizing features known as "wear knuckles", sometimes interchangeably referred to as "contact pads" or "wear knots", are used to stabilize the drill bit by controlling lateral movement of the bit, lateral vibration, and depth of cut. These stabilizing features project from the bit face, either trailing or leading a corresponding cutting element with respect to a rotational direction about a bit axis.

One characteristic of fixed-head bits having conventional stabilizing features is that the cutting elements extend outwardly of the stabilizing features, to contact the formation in advance of the stabilizing features. The stabilizing features are designed not to contact the formation until the bit advances at a selected minimum rate or depth of cut ("DOC"). In many cases, stabilizing features therefore do not sufficiently support the fragile cutting surface. In other cases, the cutting elements may penetrate further into the formation than predicted by the stabilizing features, so that the cutting tips become overloaded despite the presence of the stabilizing features. Furthermore, the manufacturing process used to create these bits may not allow the accuracy required to consistently reproduce a desired minimum DOC. One or more stabilizing features may contact the formation while others have clearance. This imbalance can introduce additional instability. Therefore, an improved apparatus and method for stabilizing a drill bit are desirable.

Further, bit stability while drilling may be achieved using two methodologies. An active method may be a bit designed to have minimum imbalanced force or desired high imbalanced force in certain directions. A passive method may be a bit designed to use features to suppress the magnitude of instability. In real applications, due to formation inhomogeneity and drill string vibration, a stable bit is often subject to varying load and drills in unstable mode. Thus, passive stability may be desirable on a bit if stability is of interest. Features such as these may be sufficient in providing protection with some lateral vibrations, however, may not provide enough protection from significant whirl and/or torsional vibrations.

Accordingly, there exists a need for improving the stability of fixed cutter bits, including reducing the magnitude of instability when vibrations occur during drilling operations.

SUMMARY OF INVENTION

In one aspect, embodiments disclosed herein relate to a drill bit having a bit body, a plurality of cutting blades extending radially from the bit body and having cutting elements disposed thereon, the plurality of cutting blades forming a cutting blade gage pad diameter configured to contact a formation, and a plurality of raised volumes of material extending from the bit body and devoid of cutting elements, the plurality of raised volumes of material forming a gage pad diameter configured to contact the formation, wherein the plurality of cutting blades and the plurality of raised volume of material are circumferentially spaced having fluid courses that extend therebetween.

In another aspect, embodiments disclosed herein relate to drill bit having a bit body with a face, a gage region, and a rotational axis extending therethrough, a plurality of cutting blades extending radially from the rotational axis and extending axially from the face to the gage region, the plurality of cutting blades comprising cutting elements disposed thereon, a plurality of gage pads extending axially into the gage region from the plurality of cutting blades, wherein each gage pad has a gage surface, a cutter-proximal side, a blade end side, a leading side and a trailing side, at least one stabilization pad, each stabilization pad having a top surface, a face-proximal side, a face-distal side, a leading side, and a trailing side, wherein each stabilization pad is disposed circumferentially about the bit body in the gage region between a pair of adjacent gage pads, wherein each stabilization pad comprises less than 50 percent of the arc length between the pair of adjacent gage pads, and wherein the drill bit comprises at least two and less than five blades Other aspects and advantages of the invention will be apparent from the following description and the appended claims.

DETAILED DESCRIPTION

In one aspect, embodiments disclosed herein relate to apparatus and methods involving cutting tools in oilfield applications. More particularly, embodiments disclosed herein relate to drill bits having additional blades and/or gage pads to achieve and maintain better stability during drilling operations.

Figure 1:
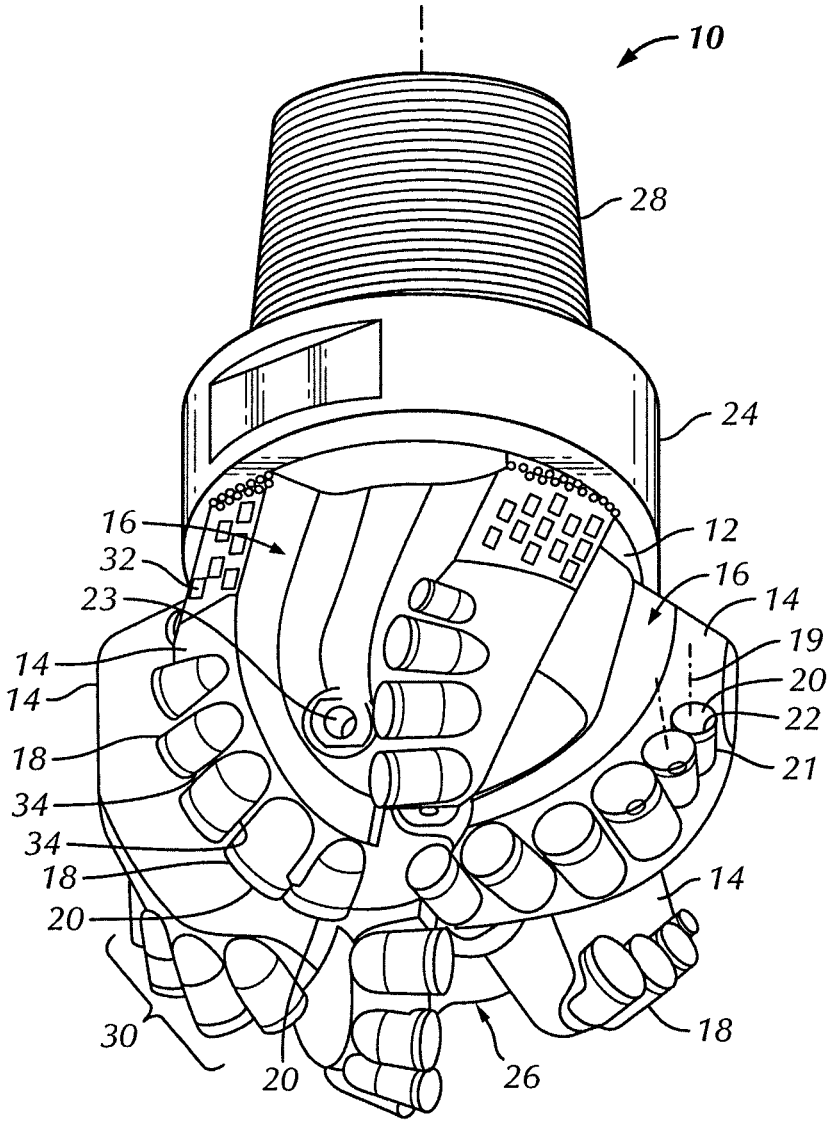
FIG. 1 (Prior Art)
FIG. 1 shows a conventional drag bit.
Figure 2:
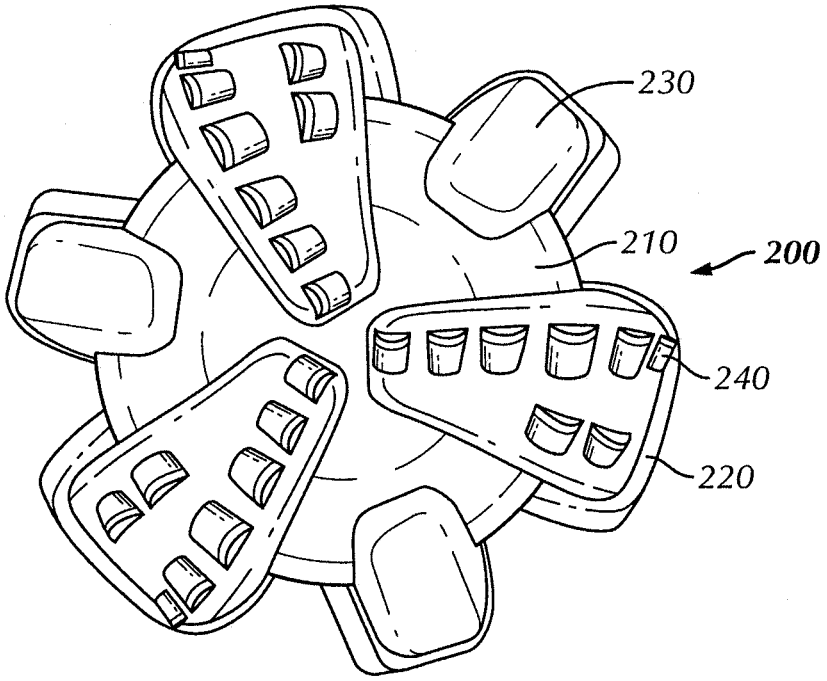
FIG. 2 shows a drill bit comprising utility blades in accordance with embodiments of the present disclosure.

Referring to FIG. 2, a bottom view of a drill bit 200 is shown in accordance with embodiments of the present disclosure. Drill bit 200 comprises a bit body 210, cutting blades 220 extending radially from bit body 210, and cutting elements 240 disposed on cutting blades 220. Drill bit 200 further comprises utility blades 230 extending radially from bit body 210, utility blades 230 being free of cutting elements. As used herein, the term "utility blade" refers to a raised volume of material extending from the bit body or blade having no cutting elements disposed thereon that may be used to provide a variety of utilities or features to the bit. Such utilities or features may include drilling stability improvements, downhole sensing equipment, and cleaning features such as nozzles. In accordance with some embodiments of the invention, the shape and width of the utility blades may be pre-optimized for a given application. Pre-optimization or pre-configuration may be based on simulation or other information, such as type of formation to be drilled and other drilling condition information. As discussed herein, improved stability may be achieved by the increased contact area provided by the volume of material raised or extending from the bit body, particularly in the gage region of the bit. However, design of the bit may include analysis on the amount of increased contact area that may improve stability, as well as the amount of friction created by such increased contact area.

As shown, utility blades 230 and cutting blades 220 may be arranged in an alternating configuration around a center of bit body 210; however, a person skilled in the art will understand that other suitable arrangements may be possible. Further, while embodiments disclosed herein show three cutting blades and three utility blades, it will be understood by those skilled in the art that varying numbers of cutting blades and utility blades may be used. Still further, cutting elements 240 on cutting blades 220 may have various configurations, for example, varying numbers of cutting elements 240, uneven or even spacing along cutting blade 220, etc. Different configurations of cutting elements 240 will be know to those skilled in the art.

Figure 3:
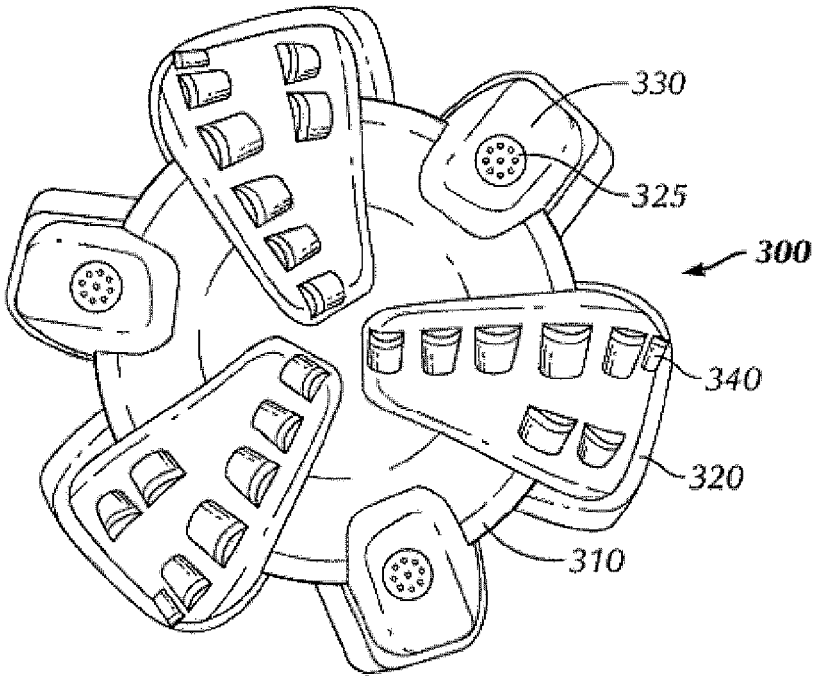
FIG. 3 shows a drill bit comprising utility blades having wear indicators in accordance with embodiments of the present disclosure.

Referring to FIG. 3, a bottom view of a drill bit 300 is shown in accordance with embodiments of the present disclosure. Drill bit 300 comprises a bit body 310, cutting blades 320 extending radially from bit body 310, and cutting elements 340 disposed on cutting blades 320. Drill bit 300 further comprises utility blades 330 extending radially from bit body 310, the utility blades 330 being free of cutting elements. Utility blades 330 may comprise wear indicators 325 disposed thereon. Wear indicators 325, as described herein, may be tungsten inserts, diamond enhanced inserts, diamond impregnated inserts, or other material suitable for wear as known to those skilled in the art. Wear indicators 325 may also be PDC cutters with substantially larger bevel size or substantially larger back rake angles than active cutting elements 340. They may also be positioned lower than cutting elements 340 to further reduce their cutting aggressiveness so they act mainly as wear indicators. As shown, wear indicators 325 are mounted on a bottom face of utility blades 330; however, they may alternatively be mounted on a side face, or a gage diameter formed by outer profiles of utility blades 330. In certain embodiments with wear indicators mounted on the gage diameter of utility blades 330, the gage diameter of utility blades 330 may be equal to or slightly less than a gage diameter formed by outer profiles of cutting blades 320. In one example, the gage diameter of utility blades 330 may be between about 0.01 inches and 0.15 inches less than the gage diameter of cutting blades 320. Further, with wear indicators 325 mounted on a bottom face of utility blades 330, a height of utility blades 330 may be equal to or slightly less than the height of cutting blades 320. The utility blades 330 may also be higher than cutting blades 320, but lower than the cutting profile formed by the cutting elements 340. In embodiments disclosed herein, "cutting action" of cutting elements 340 on cutting blades 320 may occur first, and as cutting elements 340 on cutting blades 320 "wear down" to a certain height, wear indicators 325 may contact a formation being drilled to signal a need to change cutting elements 340. Wear indicators 325 may be attached to utility blades 330 in various ways known to those skilled in the art, including welding, brazing, adhesives, and fasteners.

Figure 4:
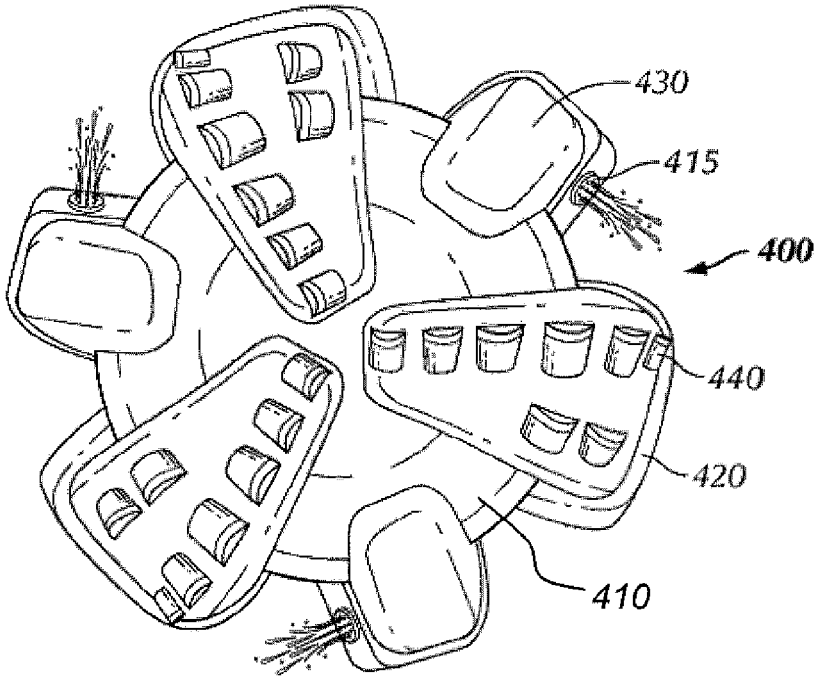
FIG. 4 shows a drill bit comprising utility blades having nozzles in accordance with embodiments of the present disclosure.

Referring now to FIG. 4, an end view of a drill bit 400 is shown in accordance with embodiments of the present disclosure. Drill bit 400 comprises a bit body 410, cutting blades 420 extending radially from bit body 410, and cutting elements 440 disposed on cutting blades 420. Drill bit 400 further comprises utility blades 430 extending radially from bit body 410, utility blades 430 being free of cutting elements. Drill bit 400 comprises flow conduits (not shown) to which flow nozzles 415 are attached, the flow nozzles 415 configured to impinge on cutting elements 440 mounted on cutting blades 420. In certain embodiments, flow nozzles 415 may be configured to impinge on cutting elements 440 towards an outer circumference of drill bit 400. Further, the geometry of utility blades 430 may be changed to determine a flow direction from flow nozzles 415 as desired. In selected embodiments, flow nozzles 415 may be adjustable to concentrate fluid flow from them onto desired cutting elements 440 or areas of cutting blades 420 depending on drilling conditions. Alternatively, drill bit 400 may be used without regular flow nozzles extending through or from a bit body.

The optimal placement, directionality and sizing of the flow nozzles 415 may vary depending on the bit size and formation type that is being drilled. For instance, in soft, sticky formations, drilling rates may be reduced due to "bit balling", or when the formation sticks to the cutting blades. As the cutters attempt to penetrate the formation, they may be restrained by the formation stuck to the cutting blades, reducing the amount of material removed by the cutting element and slowing the rate of penetration (ROP) of the drill bit. In this instance, fluid directed toward the cutting blades may help to clean the cutting elements and cutting blades allowing them to penetrate to their maximum depth, maintaining the rate of penetration for the bit. Furthermore, as the cutting elements begin to wear down, the bit may drill longer because the cleaned cutting elements will continue to penetrate the formation even in their reduced state.

Referring back to FIG. 2, in certain embodiments of the present disclosure, utility blades 230 may be formed from various materials including, for example, the particular bit body material such as steel and a composite matrix material or in other embodiments, may include a diamond impregnated material. For example, diamond impregnated utility blades 230 may be used in combination with PDC cutters on cutting blades 220 for drilling in formations with a mixture of soft and hard layers. Such a material may be formed by using an abrasive material, such as diamond, impregnated into the surface of the material forming the bit body. Typically, bit type may be selected based on the primary nature of the formation to be drilled. However, many formations have mixed characteristics (i.e., the formation may include both hard and soft zones), which may reduce the rate of penetration of a bit (or, alternatively, reduces the life of a selected bit) because the selected bit is not preferred for certain zones. One type of "mixed formation" includes abrasive sands in a shale matrix. In this type of formation, if a conventional impregnated bit is used, because the diamond table exposure of this type of bit is small, the shale can fill the gap between the exposed diamonds and the surrounding matrix, reducing the cutting effectiveness of the bit (i.e., decreasing the rate of penetration (ROP)). In contrast, if a PDC cutter is used, the PDC cutter will shear the shale, but the abrasive sand will cause rapid cutter failure (i.e., the ROP will be sufficient, but wear characteristics will be poor). Thus, when drilling in a mixed formation using a bit of the present disclosure, the PDC cutters may be more efficient, while when drilling in harder layers, the diamond impregnated utility blades may be better suited for grinding away at the formation.

Further, embodiments of the present disclosure may comprise utility blades 230 which contain downhole drilling sensing equipment. For example, mechanical or electronic devices for measuring various properties in the well such as pressure, fluid flow rate from each branch of a multilateral well, temperature, vibration, composition, fluid flow regime, fluid holdup, bit RPM, bit accelerations, etc. may be disposed inside utility blades 230. One of ordinary skill in the art will understand the various options for installing sensors in the utility blades. Further, measurement-while-drilling (MWD) equipment and logging-while-drilling (LWD) equipment to measure formation parameters such as resistivity, porosity, etc. may be installed directly in the utility blades on the drill bit.

Figure 5:
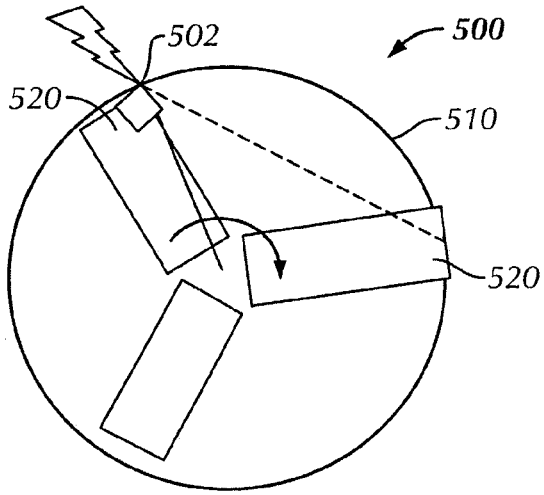
FIG. 5 (Prior Art)
FIG. 5 shows a prior art drill bit without utility blades during drilling.

Further, embodiments disclosed herein may provide a drill bit capable of increased drilling speeds without sacrificing stability. The drilling speed, or rate of penetration (ROP), typically increases with a bit having fewer cutting blades; however, in such a bit, the reduced number of blades leads to increased instability. Thus, bits of the present disclosure may allow for increased ROPs while also maintaining stability. Referring to FIG. 5, a bottom view of a conventional drag bit 500 having three cutting blades 520 extending from a bit body 510 is shown during a downhole drilling operation. As drill bit 500 rotates downhole, torsional vibrations or bit whirl as previously described may cause severe impact loading 502 on cutting blades 520 as shown. Resultant loads at impact point 502 may be large enough to cause damage to cutting blades 520 and cutting elements (not shown) disposed on cutting blades 520.

Figure 6A:
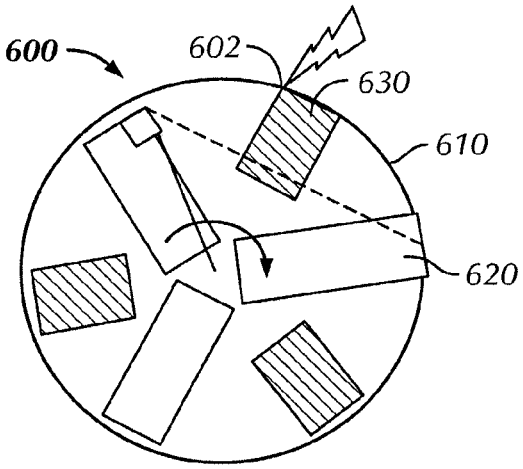
FIG. 6A-6B shows a drill bit comprising utility blades during drilling in accordance with embodiments of the present disclosure.
Figure 6B:
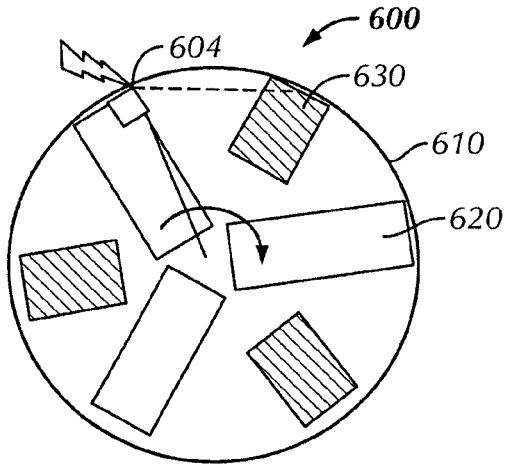

Referring to FIG. 6A, a bottom view of a drill bit 600 in accordance with embodiments of the present disclosure is shown during a drilling operation. Drill bit 600 comprises a bit body 610 and three cutting blades 620 similar to those on conventional bit 500 (FIG. 5) extending radially from bit body 610 with cutting elements (not shown). Furthermore, bit 600 also includes utility blades 630 free of cutting elements extending radially from bit body 610. During drilling, the effects of bit whirl may be reduced by utility blades 630 as they are configured to absorb portions of the impact loading as seen at impact point 602. Referring to FIG. 6B, as drill bit 600 continues to rotate downhole, main blades 620 still absorb impact loads, however, they may be significantly reduced as shown at impact point 604.

The utility blades disposed on the bit body may mitigate the magnitude of instability when vibrations occur during the drilling operation. Adding the utility blades to the drill bit may increase the gage contact area around the circumference of the drill bit providing more contact area between the drill bit and the formation being drilled. For example, the drill bit has more gage contact area by having six blades (three cutting blades and three utility blades) rather than just three cutting blades. Therefore, the added gage contact area may increase the stability of the drill bit during drilling operations with reduced impact loads by providing more contact points around the drill bit circumference. Further, rate of penetration of the drill bit may increase due to the reduced vibrations and bit whirl. The less the drill bit is allowed to "wobble" around in the borehole, the faster the bit may drill. The increased rate of penetration (ROP) of embodiments disclosed herein may further reduce drill time and associated drilling costs.

In such embodiments where the raised volume of material is particularly desirable in the gage region of the bit, it may not be necessary to have this volume of material extend along the entire face of the bit body from the gage toward the centerline of the bit. In such an instance, the raised volume of material having no cutting elements disposed thereon may be referred to as "stabilization pads," which are separate from gage pads, but located in the gage region of the bit, circumferentially spaced between gage pads. "Gage pads," as used herein, refer to pads extending radially from the bit body as an extension of the cutting blades in the gage region of the bit, wherein each gage pad includes a radially outer gage surface. The gage surfaces of the plurality of gage pads extending from a bit body define a gage pad circumference, which is typically considered the diameter or "gage" of the drill bit and equivalent to the diameter of the borehole formed in the drilling process. Stabilization pads may possess similar attributes as gage pads as an extension of utility blades, or they may be present in the gage region and not along the shoulder, nose, or cone region of the bit.

Stabilization pads may be formed from the same material as the bit body, or different material from the bit body. For example, stabilization pads may be formed from a cemented carbide, such as tungsten carbide, boron carbide, boron nitride, aluminum nitride, tungsten boride, carbides or borides of Ti, Mo, Nb, V, Hf, Zr, Ta, Si, and Cr, and one or more of iron-based alloys, nickel-based alloys, cobalt- and nickel-based alloys, aluminum-based alloys, copper based alloys, magnesium-based alloys, and titanium-based alloys. A bit body may be formed from a matrix material (e.g., by infiltrating tungsten carbide particles with a molten metal alloy such as a cobalt-based alloy) or from steel (e.g., machined from steel castings or forgings). The outer surface of a stabilization pad may include an abrasion-resistant surface and/or a bearing surface to reduce friction between the stabilization pad and the borehole wall such as, for example, by coating the stabilization pad with a low-friction material. Further, the stabilization pads may be formed with the bit body (at the same time) or the stabilization pads may be formed separately from the bit body and then welded or otherwise attached to the bit body.

Figure 7B:
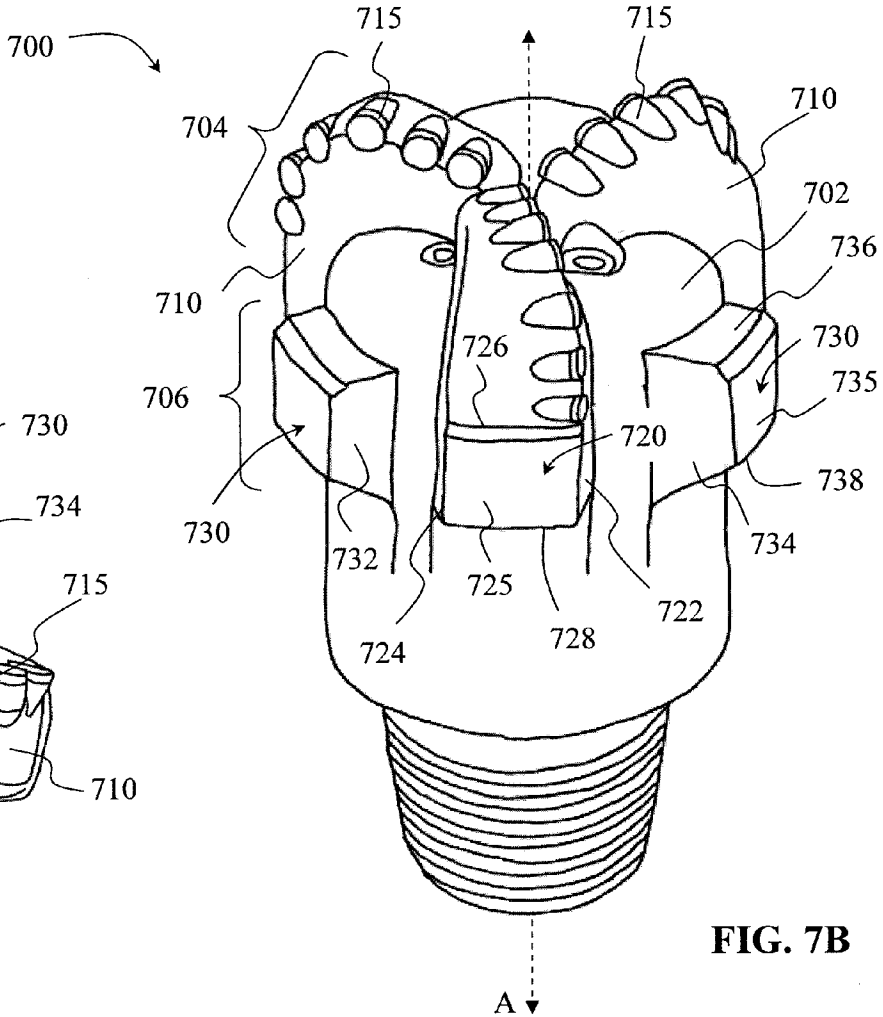
FIGS. 7A and 7B show a top and perspective view of drill bits according to embodiments of the present disclosure.
Figure 7A:
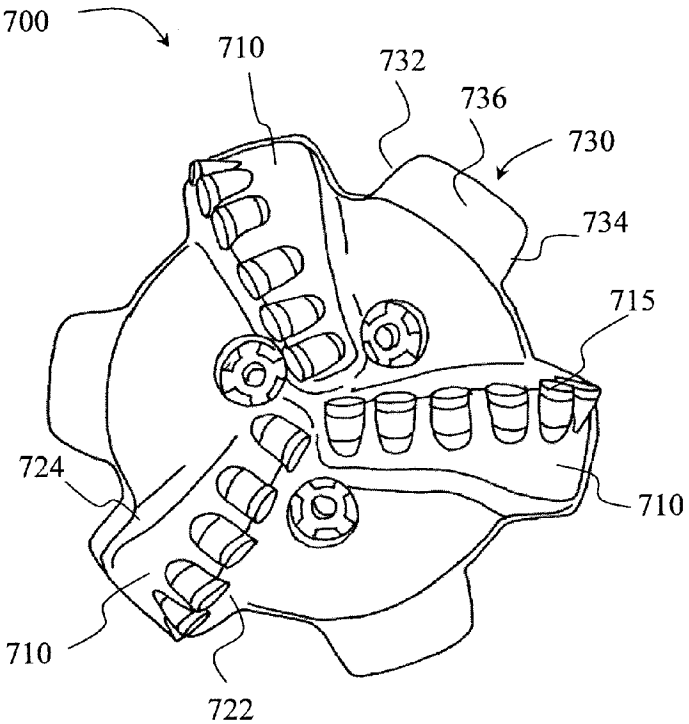

According to some embodiments, bit stability may be enhanced by positioning stabilization pads circumferentially around the gage region of the bit. Referring to FIGS. 7A and 7B, a top view (FIG. 7A) and a perspective view (FIG. 7B) of a drill bit 700 according to the present disclosure are shown, wherein the bit 700 includes a bit body 702 having a face 704, a gage region 706, and a rotational axis A extending therethrough. The bit 700 has a plurality of cutting blades 710 extending radially from the rotational axis A and extending longitudinally (i.e., axially) from the face 704 to the gage region 706, the plurality of cutting blades 710 comprising cutting elements 715 disposed thereon. The portion of the bit 700 having cutting blades 710 may be referred to as the "active cutting structure," as the cutting blades 710 (and the cutting elements 715 thereon) are typically providing the majority of the bit's cutting action. The gage region 706 may begin where the active cutting structure ends. As used herein, the terms "axially" and "longitudinal" generally mean along or parallel to the bit rotational axis, while the term "radially" generally means perpendicular to the bit axis. For example, an axial distance refers to a distance measured parallel to the rotational axis, and a radial distance means a distance measured perpendicular from the rotation axis of the bit.

The portion of each cutting blade 710 forming the gage pad 720 has a leading side 722, a trailing side 724, and a gage surface 725, and wherein each gage pad 720 is in the gage region 706 of the bit body 702. Each gage pad 720 may be defined between the end of the active cutting structure, a cutter-proximal side 726, and end of the cutting blade 728. The gage surface 725 of the gage pads 720 refers to the radially outer surface of a gage pad generally facing the formation being drilled (located opposite from the bit body) that may form the diameter of the drill bit and establish the bit's size. At least one stabilization pad 730 may be disposed circumferentially about the bit body 702 in the gage region 706 between a pair of adjacent gage pads 720, wherein each stabilization pad 730 has a leading side 732, a trailing side 734, a top surface 735, a face-proximal side 736, a face-distal side 238, and wherein each stabilization pad extends less than 50 percent of the arc length between the pair of adjacent gage pads 720. The top surface 735 of the stabilization pads 730 refers to the radially outer surface of a stabilization pad that generally faces the formation being drilled, and is located opposite from the bit body. For purposes of differentiation, the outer surface of a gage pad may be referred to herein as a "gage surface," and the outer surface of a stabilization pad may be referred to herein as a "top surface." However, it should be noted that both the gage surface and top surface refer to surfaces that face radially outward from the rotational axis of the bit.

Advantageously, as described above, the stabilization pads of the present disclosure provide additional points of contact with a borehole wall so that drill bits having between two and five blades, which are conventionally subject to increased amounts of bit whirl, may have increased stability. Further, by forming stabilization pads separate from the gage pads, with spacing (fluid courses) therebetween, less surface area contacts the borehole wall, and thus the bit may be subject to less frictional-related failures.

Figure 8:
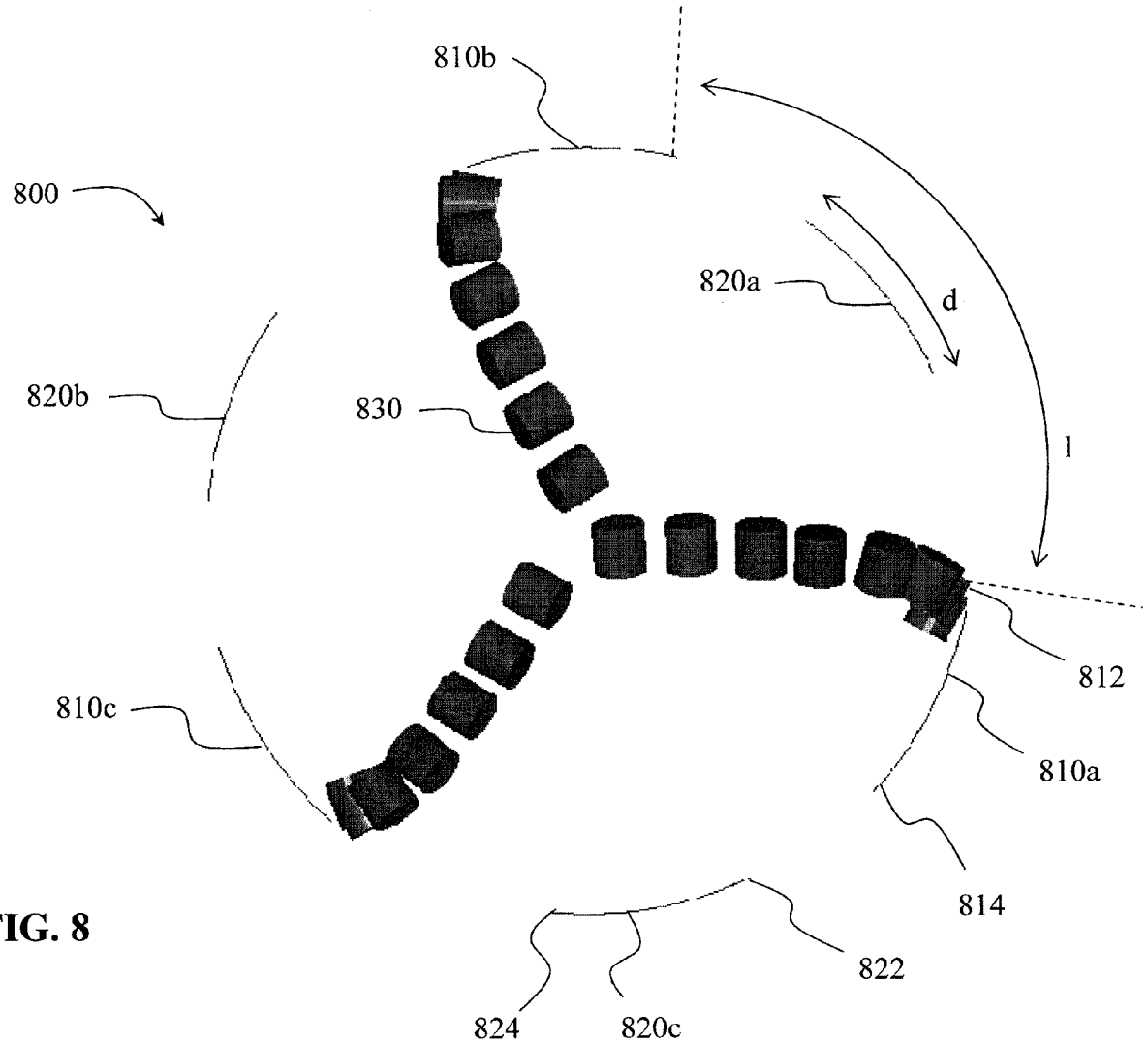
FIG. 8 is a profile view of the top of a drill bit according to embodiments of the present disclosure.

Referring to FIG. 8, the profile of a drag bit according to embodiments of the present disclosure is shown, wherein the profile shows the placement of gage pads 810*a*, 810*b*, 810*c*, stabilization pads 820*a*, 820*b*, 820*c*, and cutters 830 on the cutting blades (not shown). Each gage pad 810*a*, 810*b*, 810*c* is an extension from a cutting blade (not pictured), wherein a gage pad is defined as the part of the blade between the active cutting structure and the end of the blade, located substantially and axially contiguous with the cutting portion of the blade. The gage pads 810*a*, 810*b*, 810*c* each have a leading side 812 and a trailing side 814, wherein the leading side 812 of a gage pad faces in the direction of rotation of the bit (with cutters 830) and the trailing side 814 of a gage pad is opposite from leading side 812. A stabilization pad 820*a* is positioned within the arc length 1 measured between the leading side 812 of gage pad 810*a* to the trailing side 814 of an adjacent gage pad 810*b*. Likewise, stabilization pad 820*b* may be positioned with the arc length measured between leading side 812 of gage pad 810*b* to the trailing side 814 of an adjacent gage pad 810*c*, and stabilization pad 820*c* may be positioned with the arc length measured between leading side 812 of gage pad 810*c* to the trailing side 814 of an adjacent gage pad 810*a*. Stabilization pads 820*a*, 820*b*, 820*c* each have a leading side 822 and a trailing side 824, wherein the leading side 822 faces in the direction of rotation of the bit and the trailing side 824 is opposite from the leading side 822.

As shown, a stabilization pad 820*a* may be positioned within the arc length 1 between two adjacent gage pads 810*a* and 810*b* such that a circumferential spacing or fluid course is between the stabilization pad 820*a* and each of the two adjacent gage pads 810*a*, 810*b*. In particular, the leading side 822 of a stabilization pad 820*a* may be a distance away from the trailing side 814 of an adjacent gage pad 810*b* and the trailing side 824 of the stabilization pad 820*a* may be a distance away from the leading side 812 of an adjacent gage pad 810*a*. For example, in one embodiment, the distance between the leading side of the stabilization pad and the trailing side of one of the pair of adjacent gage pads may be equal to the distance between the trailing side of the stabilization pad and the leading side of the other of the pair of adjacent gage pads. In another embodiment, the distance between the leading side of the stabilization pad and the trailing side of one of the pair of adjacent gage pads may be less than the distance between the trailing side of the stabilization pad and the leading side of the other of the pair of adjacent gage pads. In yet another embodiment, the distance between the leading side of the stabilization pad and the trailing side of one of the pair of adjacent gage pads may be greater than the distance between the trailing side of the stabilization pad and the leading side of the other of the pair of adjacent gage pads.

Further, a stabilization pad 820*a* may extend a distance d around the circumference of the bit body, wherein the distance d of a stabilization pad is equal to the distance between the leading side 812 and trailing side 814 of the stabilization pad 820*a*. For example, referring back to FIGS. 7A and 7B, the distance d of stabilization pad 730 is equal to the distance between the leading side 732 and the trailing side 734. A ratio of the distance d of the stabilization pad 820*a* to the arc length 1 between adjacent gage pads 810*a*, 810*b* (d/l) may range from 10 percent to 80 percent. In other words, a stabilization pad according to the present disclosure may extend between 10 and 80 percent of the arc length between a pair of adjacent gage pads. In a preferred embodiment, the ratio d/l may range from 25 percent to 50 percent. In yet other embodiments, each stabilization pad may extend less than 25 percent of the arc length between the pair of adjacent gage pads (i.e., a d/1 ratio of less than 25 percent).

Figure 9:
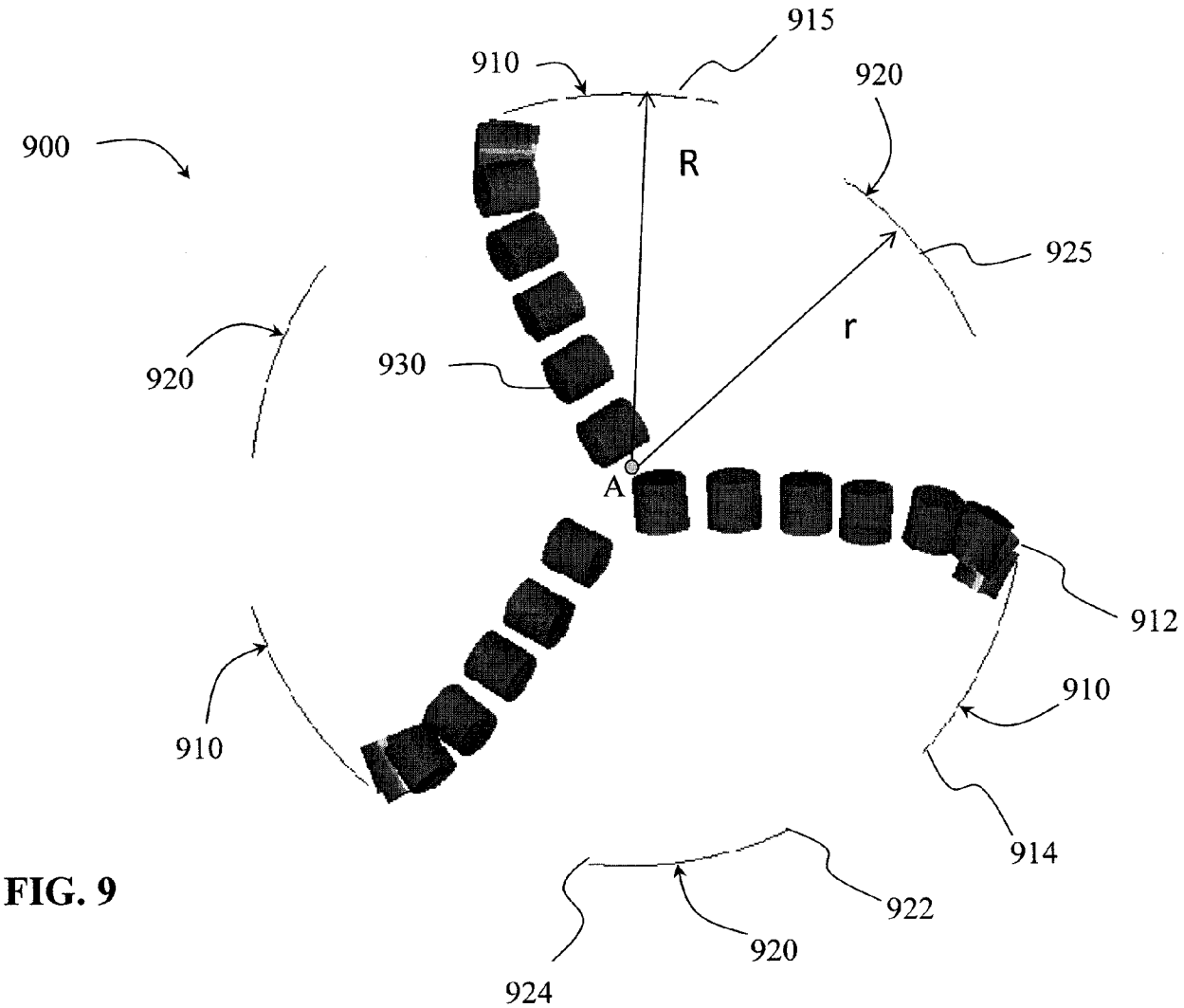
FIG. 9 is a profile view of the top of a drill bit according to embodiments of the present disclosure.

Stabilization pads may have different radial heights in various embodiments of the present disclosure, wherein the radial height may be measured from the bit body surface or the bit centerline to the outer surface of a stabilization pad along a bit radius vector. For example, referring to FIG. 9, the profile of a drag bit according to embodiments of the present disclosure is shown, wherein the profile shows the placement of gage pads 910 and cutters 930 on the bit blades (not shown) and stabilization pads 920. The gage surface 915 of the gage pads 910 defines the diameter of the drill bit 900, wherein the gage radius R is equal to the distance from the rotational axis A of the bit 900 to the gage surface 915 of a gage pad 910. The gage pads 910 each have a leading side 912 and a trailing side 914, wherein the leading side 912 of a gage pad faces in the direction of rotation of the bit and the trailing side 914 of a gage pad is opposite from leading side 912. Each stabilization pad 920 is positioned (circumferentially spaced) between a pair of adjacent gage pads, within the arc length measured between the leading side 912 of one adjacent gage pad 910 to the trailing side 914 of the other of the adjacent gage pads 910. Stabilization pads 920 each have a leading side 922 and a trailing side 924, wherein the leading side 922 faces in the direction of rotation of the bit and the trailing side 924 is opposite from the leading side 922. The stabilization pads extend a height from the bit body, wherein a stabilization pad radius r is equal to the distance from the rotational axis A of the bit 900 to the outer surface 925 of a stabilization pad 920.

According to embodiments disclosed herein, the difference between the gage radius R and stabilization pad radius r may range from 0 inches to about 0.5 inches. In some embodiments, the gage radius and stabilization pad radius difference (R−r) may range from 0 to 0.3 inches. In some preferred embodiments, the gage radius and stabilization pad radius difference (R−r) may range from 0 inches to 0.1 inches. In embodiments having a gage radius and stabilization pad radius difference (R-r) of zero, the height from the bit body surface to the gage surface may be equal to the height from the bit body surface to the outer surface of the stabilization pad, wherein the gage pads and stabilization pads may both be at gage. In embodiments having a difference in gage radius R and stabilization pad radius r of greater than 0, the height from the bit body surface to the gage surface may be greater than the height from the bit body surface to the outer surface of the stabilization pad, wherein the gage pads may be at gage while the stabilization pads may be below nominal gage.

Figure 10A:
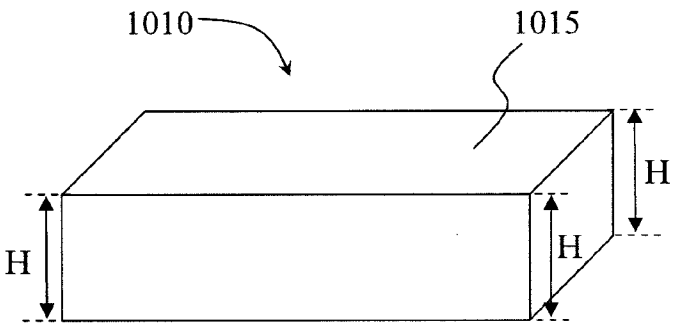
FIGS. 10A and 10B show perspective views of a gage pad and stabilization pad according to embodiments of the present disclosure.

Gage pads and stabilization pads of the present disclosure may have substantially constant radial heights, or may have varying radial heights, wherein the radial height refers to the radial distance from the bit body to the outer surface of the gage pad (gage surface) or stabilization pad (top surface). For example, referring to FIG. 10A, at least one gage pad 1010 on a bit may have a substantially constant radial height H, wherein the radial height H measured from the interface 1011 between the bit body (not shown) and the gage pad 1010 to the gage surface 1015 is substantially the same throughout the gage pad 1010. In embodiments having gage pads with a substantially constant radial height, the entire gage surface may be at gage, i.e., contact the borehole wall. Similarly, a stabilization pad according to the present disclosure may also have a substantially constant radial height, wherein the radial height measured from the interface between the bit body and the stabilization pad to the top surface is substantially the same throughout the stabilization pad. In embodiments having stabilization pads with a substantially constant radial height, the entire top surface of a stabilization pad may be either at gage or below gage.

Figure 10B:
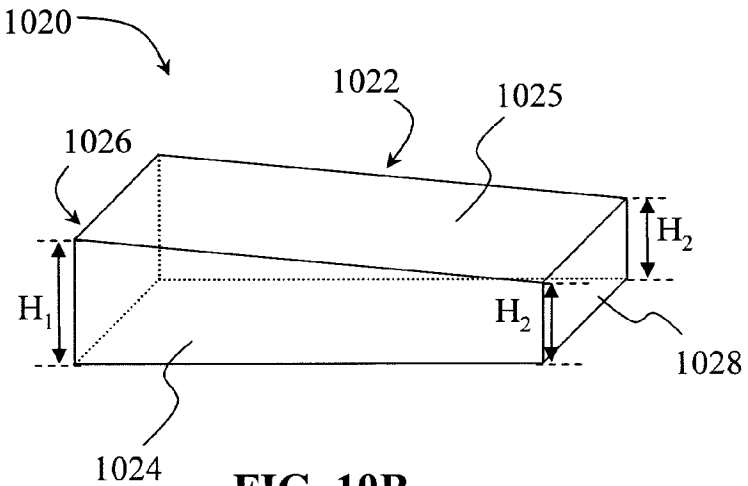

According to other embodiments of the present disclosure, the radial height of a gage pad and/or a stabilization pad may substantially continuously taper from one or two sides of the gage or stabilization pad to the opposite side(s). For example, as shown in FIG. 10B, a stabilization pad 1020 has a top surface 1025, a leading side 1022, a trailing side 1024, a face-proximal side 1026 and a face-distal side 1028. The radial height of the stabilization pad 1020 at the face-proximal side 1026 may extend to a first radial height $H_1$ (e.g., to gage), while the radial height of the stabilization pad at the face-distal side 1028 may extend to a second radial height $H_2$ that is less than the first height $H_1$, and the radial height of the stabilization pad 1020 between the face-proximal 1026 and face-distal 1028 sides may substantially continuously decrease or taper from the first height $H_1$ of the face-proximal side 1026 to the second height $H_2$ of the face-distal side 1028. Although FIG. 10B shows a radial height taper formed between the face-proximal side and face-distal side of a stabilization pad, a radial height taper may be formed between other combinations of sides, such as an increasing taper from a leading side to a trailing side or an increasing taper from the face-distal and leading sides to the face-proximal and trailing sides, for example. Further, the radial height of a stabilization pad and/or a gage pad may have a stepped taper (i.e., discontinuous taper) formed between two or more pad sides, wherein adjacent segments or portions of a pad may have a difference in radial height.

The shape and size of gage pads and stabilization pads may vary, depending on, for example, the size and type of bit and the earth formation to be drilled. For example, gage pads may have a three-dimensional rectangular shape, wherein the angles between the leading side, the cutter-proximal side, trailing side, and the cutting blade end side have substantially 90° angles between each adjacent side. Although the cutter-proximal side of a gage pad may not actually form a side that extends from the outer surface to the bit body like the leading side, trailing side, and blade end side, the cutter-proximal side may be referred to as a side of a gage pad for ease of description of the gage pad shape. In other embodiments of the present disclosure, a gage pad may have a three-dimensional parallelogram shape, wherein the angles between adjacent sides (e.g., between the leading side and the cutter-proximal side, between the leading side and the cutting blade end side, between the trailing side and the cutter-proximal side, and between the trailing side and the cutting blade end side) may include obtuse and acute angles. Likewise, stabilization pads may have a three-dimensional rectangular shape, wherein the angles between the leading side, face-proximal side, trailing side, and face-distal side have substantially 90° angles between each adjacent side, or a three-dimensional parallelogram shape, wherein the angles between adjacent sides may be obtuse and acute.

Figure 11A:
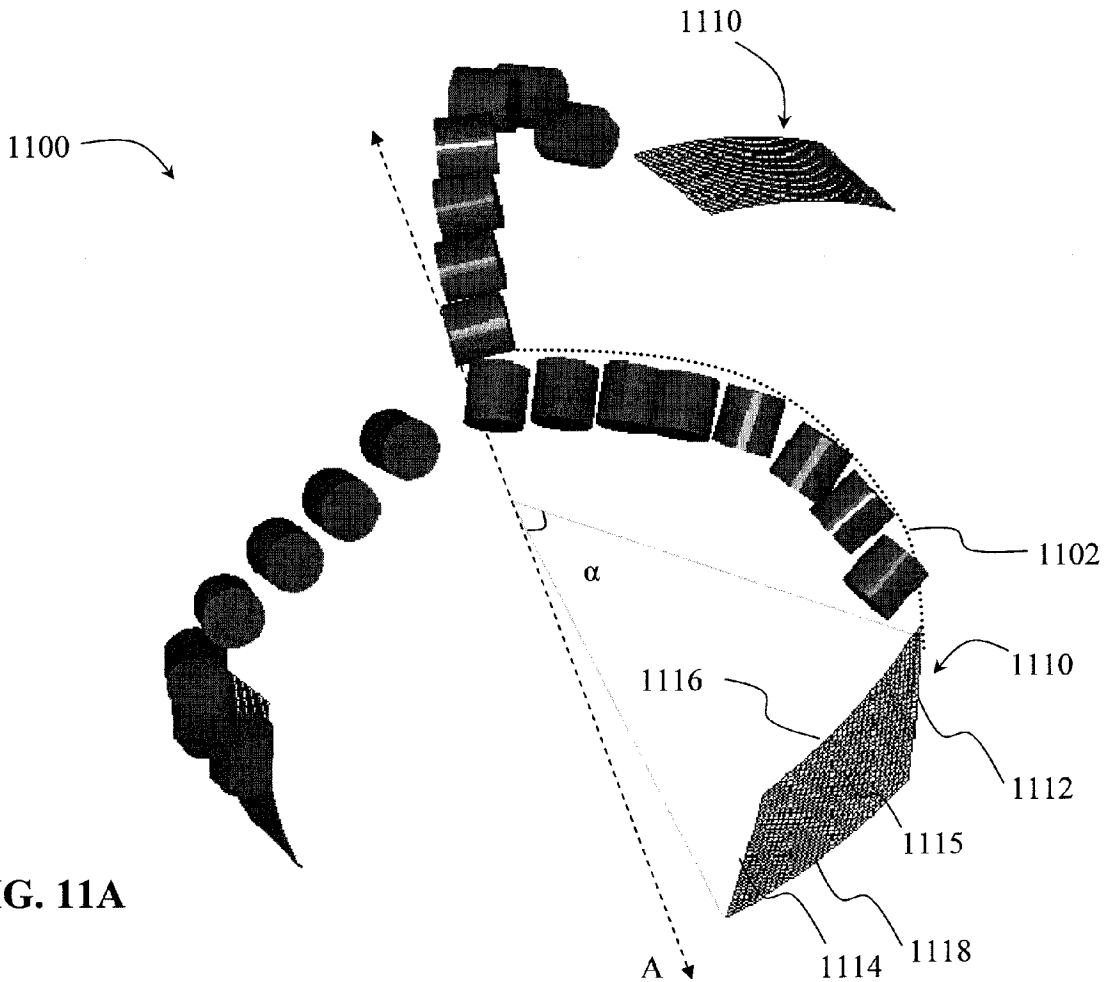
FIGS. 11A and 11B show a perspective profile and a top profile, respectively, of drill bits according to embodiments of the present disclosure.
Figure 11B:
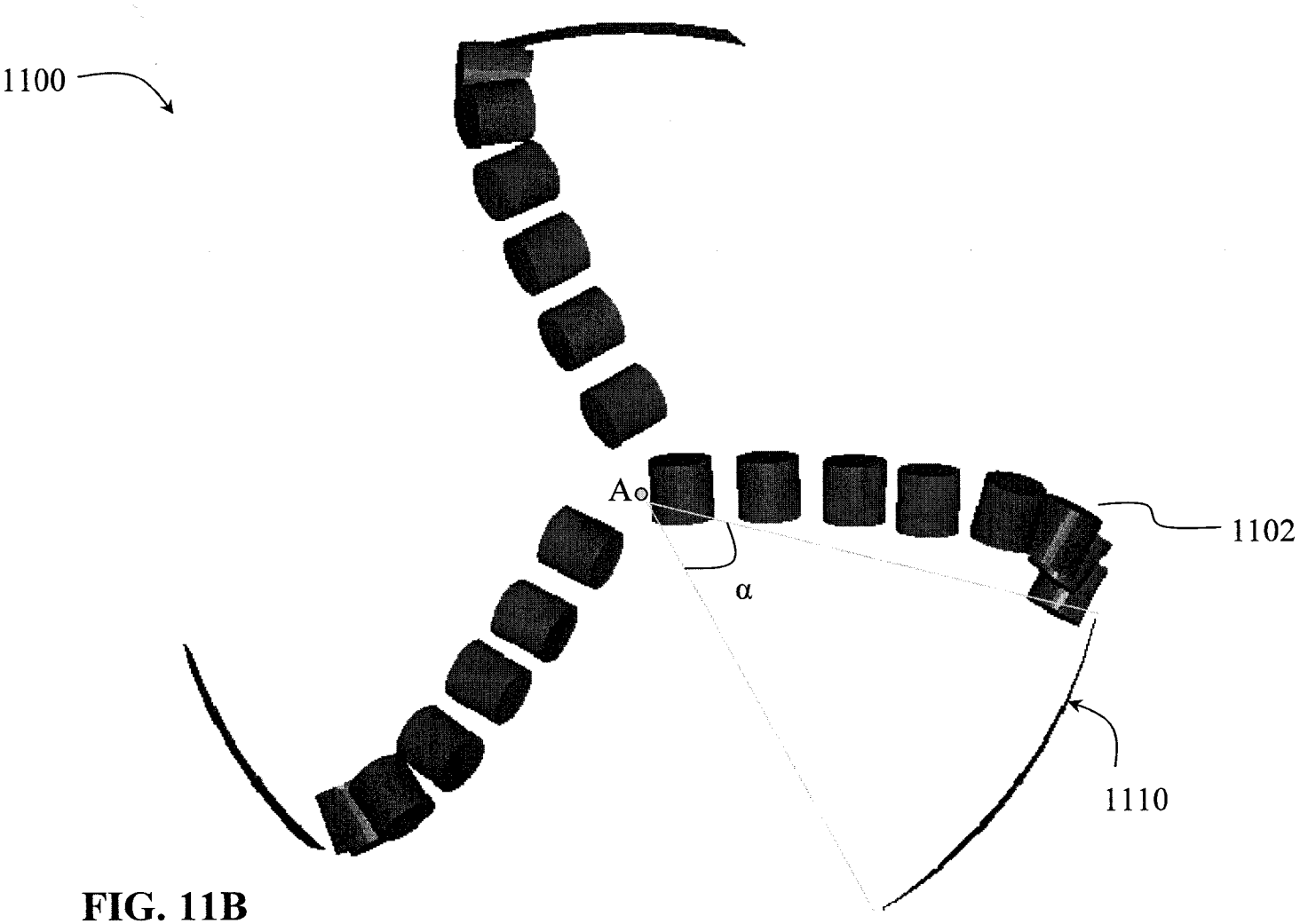
Figure 12B:
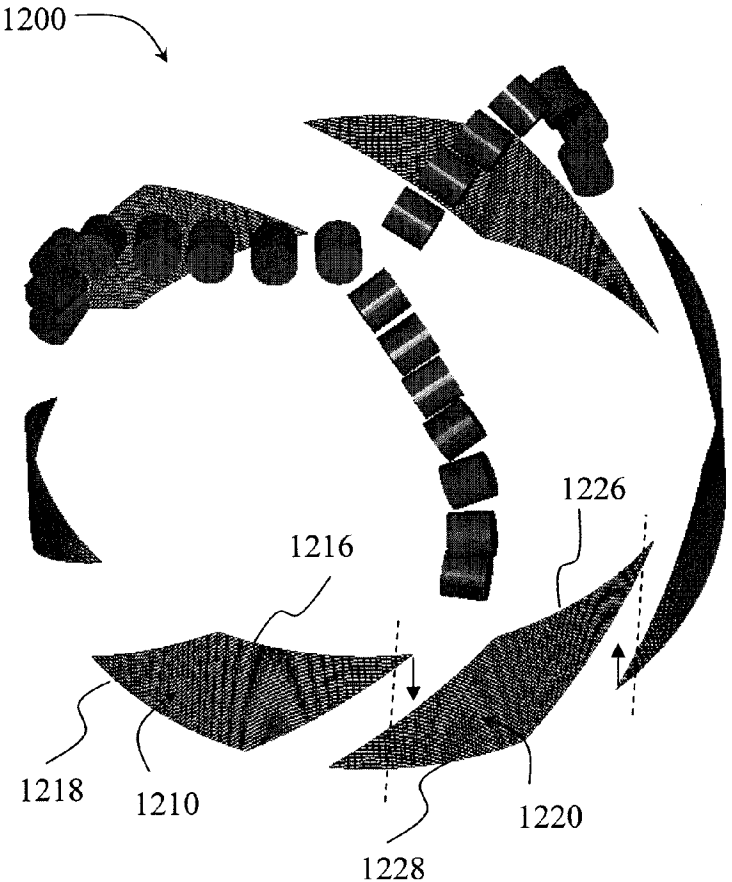
FIGS. 12A and 12B show a top profile and a perspective profile, respectively, of drill bits according to embodiments of the present disclosure.
Figure 12A:
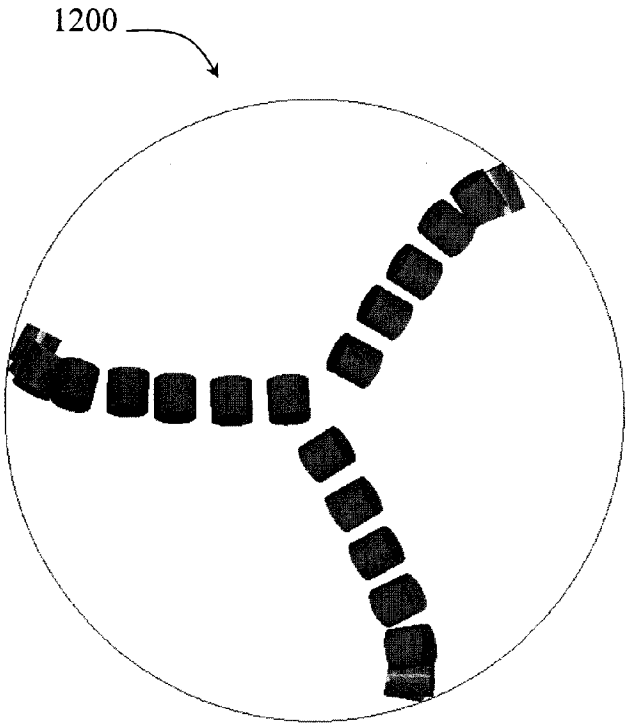

Referring to an exemplary embodiment shown in FIGS. 11A and 11B, a perspective view (FIG. 11A) and a top view (FIG. 11B) of a bit are shown, wherein the size of gage pads may be characterized by their angle of coverage α. As used herein, an angle of coverage α refers to the angle subtended by the gage pad (start to end of one pad) to the rotational axis A of the bit 1100. In other words, the angle of coverage α measures the angle formed at the rotational axis between the points of a gage pad 1110 forming the farthest circumferential distance of the gage pad 1110. As shown, gage surfaces 1115 of the gage pads 1110 have a rhombus-shape, wherein the cutter-proximal sides 1116 are circumferentially positioned closer to the leading edge 1102 of each corresponding blade than the cutting blade end sides 1118. Thus, as viewed from the top of the drill bit 1100 (FIG. 11B), the angle of coverage α for a non-rectangular shaped gage pad may be larger than the angle of coverage for a rectangular-shaped gage pad having cutter-proximal and cutting blade end sides of the same length because the points forming the farthest circumferential distance of a non-rectangular gage pad may extend farther around the circumference of the bit body than a rectangular gage pad of the same side lengths. The same size analysis may be applied to stabilization pads, wherein an angle of coverage for a stabilization pad is the angle formed at the rotational axis of a bit between the points forming the farthest circumferential distance of the stabilization pad around the gage region of a bit body. FIGS. 12A and 12B show a top view and perspective view of an exemplary embodiment of a drill bit 1200 having gage pads 1210 and stabilization pads 1220 with rhombus-shaped outer surfaces. Because the cutter-proximal side 1216 of each gage pad 1210 is positioned circumferentially at or overlapping with the position of the face-distal side 1228 of each stabilization pad 1220, and because the cutting blade end side 1218 of each gage pad 1210 is positioned circumferentially at or overlapping with the position of the face-proximal side 1226 of each stabilization pad 1220, the angles of coverage of the gage pads and stabilization pads may create 360° of circumferential coverage in the gage region of a bit. In other embodiments, the angles of coverage of the gage pads and stabilization pads may form less than 360° of circumferential coverage. For example, in some embodiments, the angles of coverage may range from 180° to 360° of circumferential coverage. In a preferred embodiment, the angles of coverage may range from 270° to 360°.

Figure 13A:
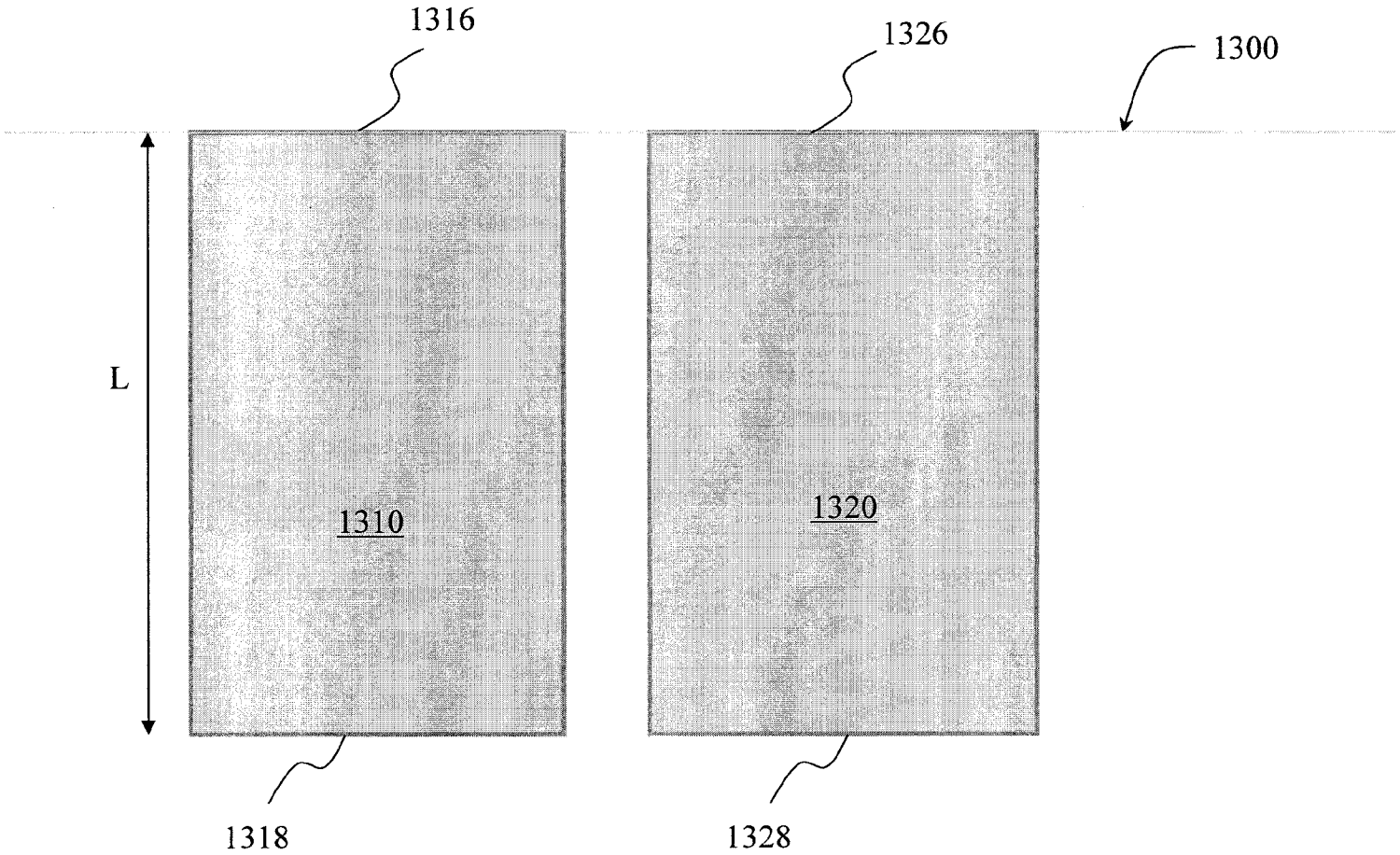
FIGS. 13A-E show diagrams of exemplary axial positions of a gage pad and a stabilization pad in relation to the active cutting region of drill bits according to the present disclosure.

According to embodiments of the present disclosure, stabilization pads may be spatially arranged in the gage region of a bit in the same longitudinal, or axial, position as gage pads, or in an axial position that overlaps with the gage pads. For example, referring to FIGS. 13A-E, a diagram of exemplary axial positions of a gage pad 1310 and a stabilization pad 1320 in relation to the active cutting region, or cutting face, of a bit are shown. As shown, the line labeled 1300 represents the end of the active cutting structure on a PDC bit according to the present disclosure, or in other words, the end of the blade region. Referring to FIG. 13A, the face-proximal side 1326 of a stabilization pad 1320 and the cutter-proximal side 1316 of a gage pad 1310 may be at equal axial positions, and the face-distal side 1328 of a stabilization pad 1320 and the cutting blade end side 1318 of a gage pad 1310 may be at equal axial positions. Thus, gage pads 1310 and stabilization pads 1320, as shown in FIG. 13A, may have equal axial lengths L. According to other exemplary embodiments, a stabilization pad may extend axially into the active cutting structure region.

Figure 13B:
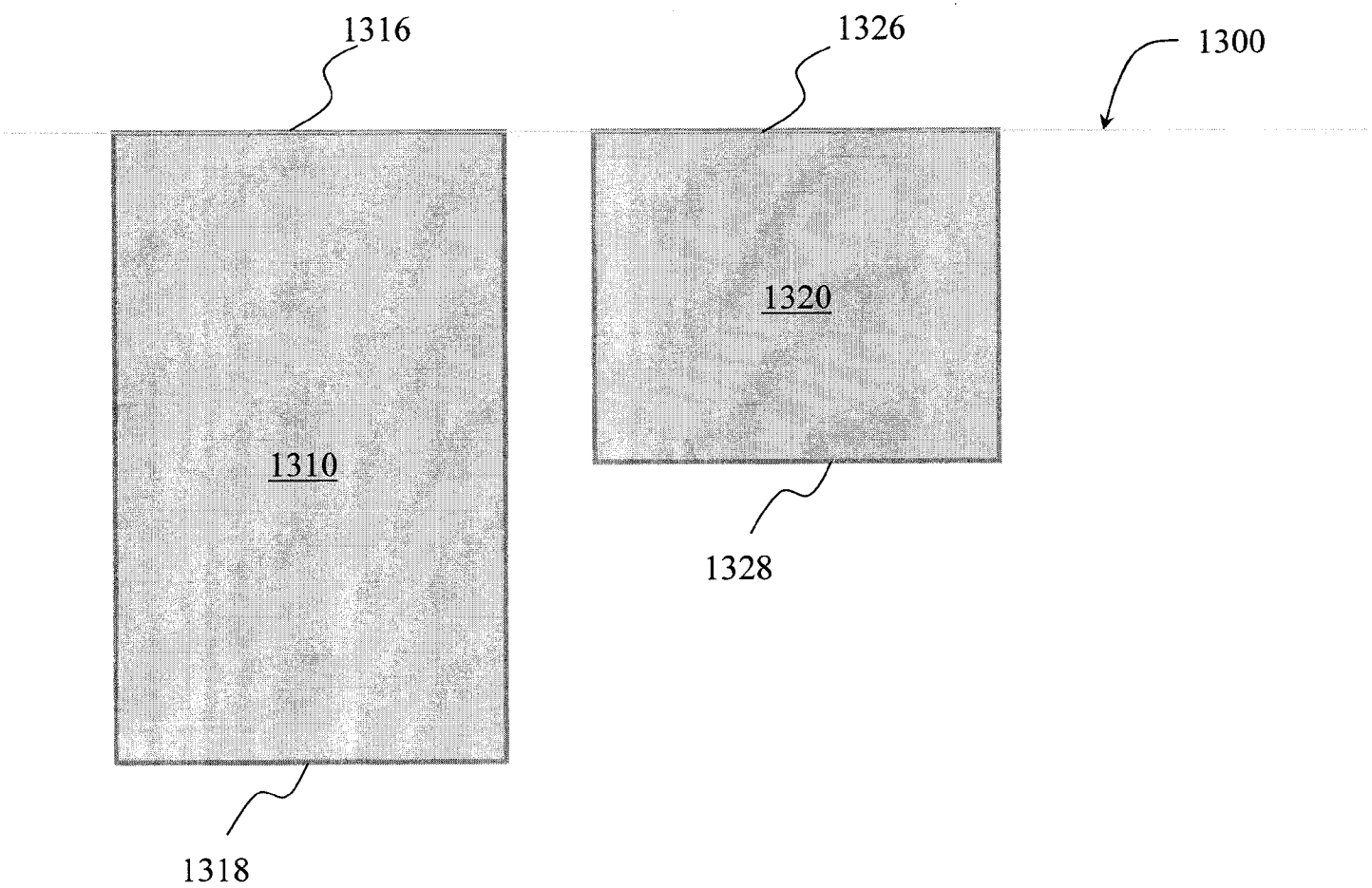
Figure 13C:
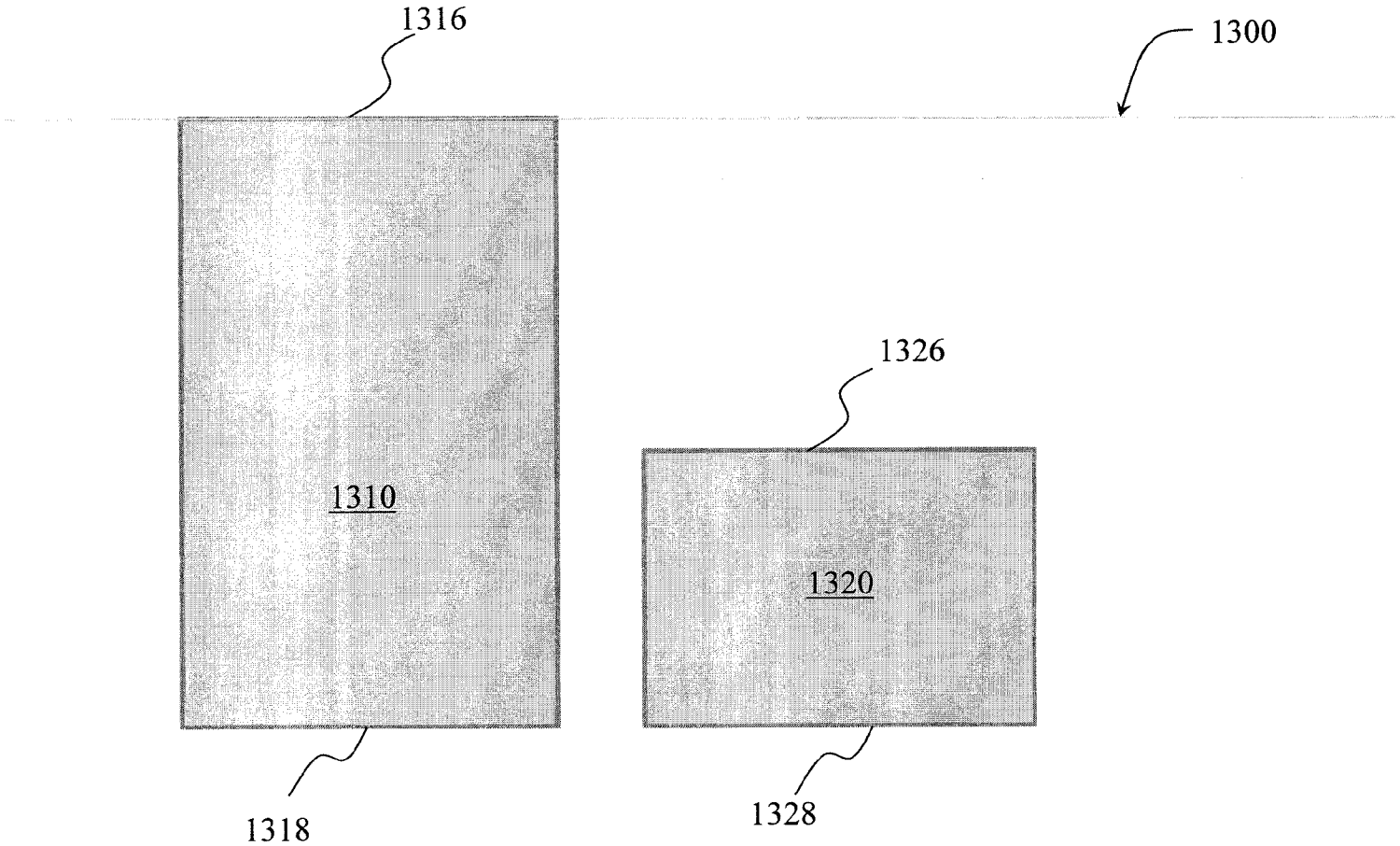

Referring now to FIG. 13B, the face-proximal side 1326 of a stabilization pad 1320 and the cutter-proximal side 1316 of a gage pad 1310 may be at equal axial positions, while the face-distal side 1328 of a stabilization pad 1320 and the cutting blade end side 1318 of a gage pad 1310 may be at different axial positions. In particular, as shown, the face-distal side 1328 of a stabilization pad 1320 may be axially positioned between the cutter-proximal side 1316 and the cutting blade end side 1318 of the gage pad 1310. However, in other embodiments, as shown in FIG. 13C, the face-distal side 1328 of a stabilization pad 1320 and the cutting blade end side 1318 of a gage pad 1310 may be at equal axial positions, while the face-proximal side 1326 of a stabilization pad 1320 and the cutter-proximal side 1316 of a gage pad 1310 may be at different axial positions. In particular, as shown, the face-proximal side 1326 of a stabilization pad 1320 may be axially positioned between the cutter-proximal side 1316 and the cutting blade end side 1318 of the gage pad 1310.

Figure 13D:
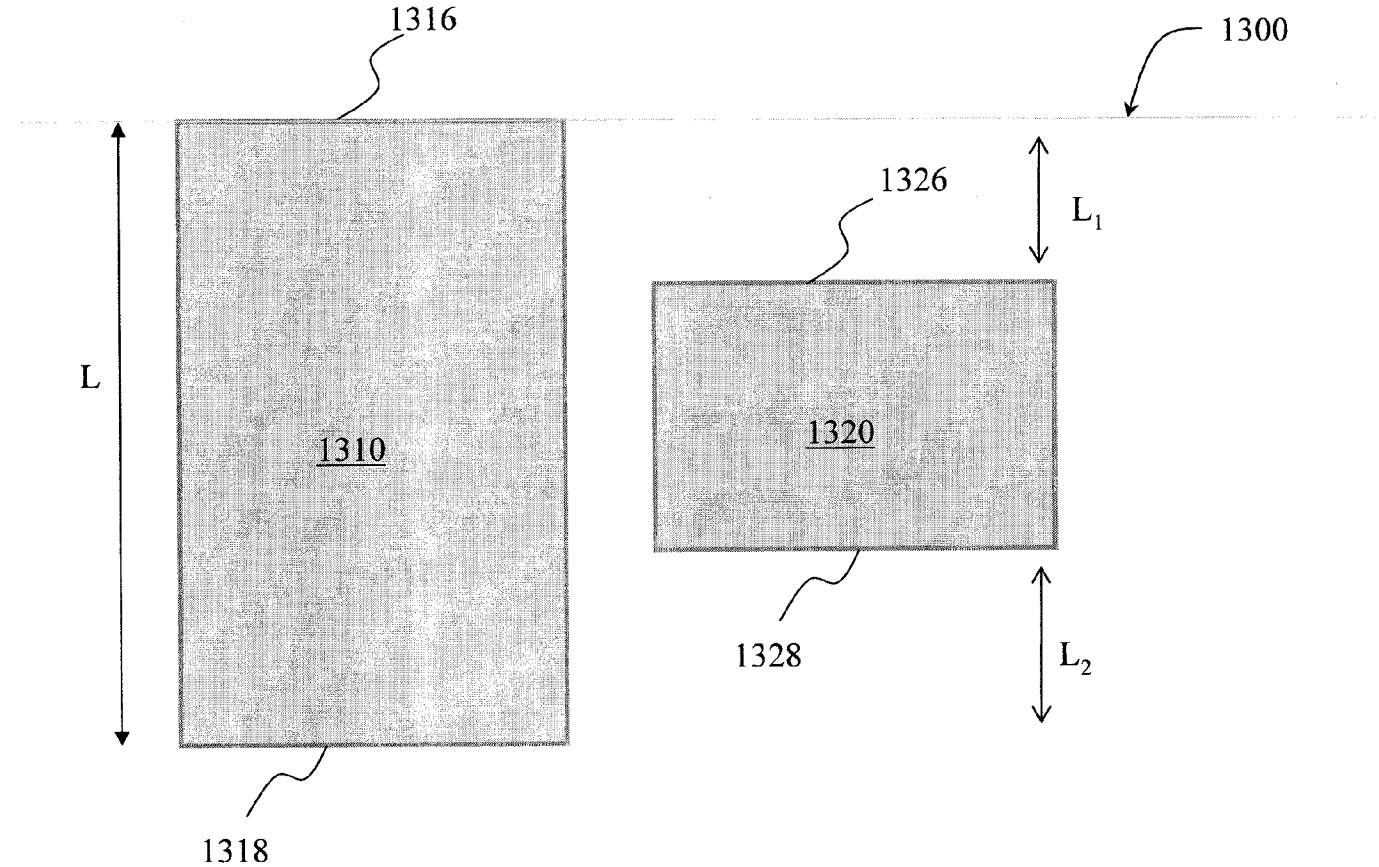

According to other embodiments, as shown in FIG. 13D, the face-proximal side 1326 and the face-distal side 1328 of a stabilization pad 1320 may both be axially positioned between the cutter-proximal side 1316 and the cutting blade end side 1318 of a gage pad 1310. In such embodiments, the face-proximal side 1326 of the stabilization pad 1320 may be axially positioned a first axial distance $L_1$ from the cutter-proximal side of the gage pad 1310, and the face-distal side 1328 of a stabilization pad 1320 may axially positioned a second axial distance $L_2$ from the cutting blade end side 1318 of the gage pad 1310. Both the first axial distance $L_1$ and the second axial distance $L_2$ may range from 0 to 50 percent of the axial length L of the gage pad 1310. In some embodiments, the first axial distance and the second axial distance may range from 10 to 30 percent of the axial length of the gage pad.

Figure 13E:
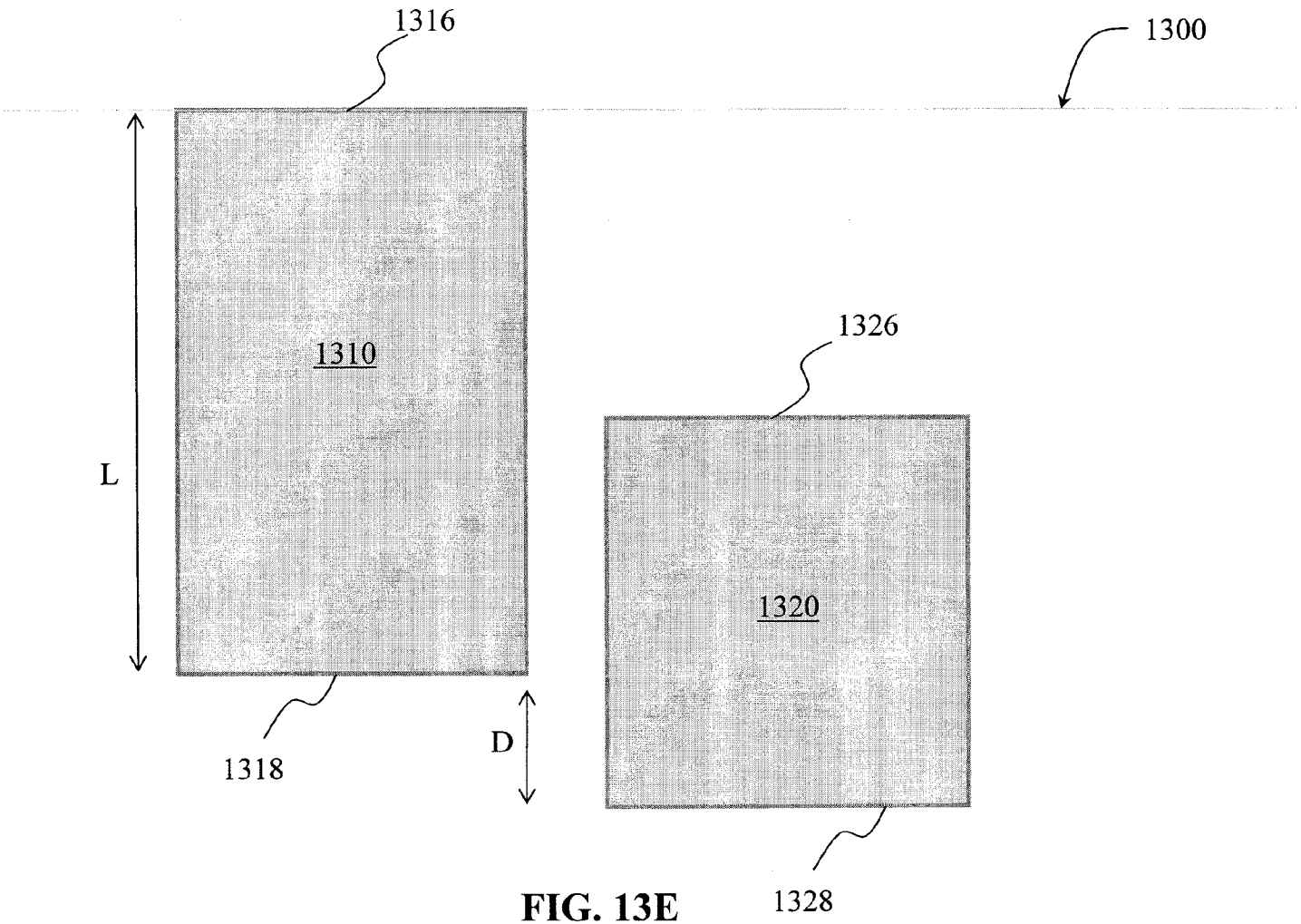

In yet other embodiments, as shown in FIG. 13E, the face-proximal side 1326 of a stabilization pad 1320 may be axially positioned between the cutter-proximal side 1316 and the cutting blade end side 1318 of a gage pad 1310, while the face-distal side 1328 of the stabilization pad 1320 may be an axial distance D farther from the end of the active cutting structure than the cutting blade end side 1318 of the gage pad 1310. In other words, the face-distal side 1328 of the stabilization pad 1320 may be axially positioned farther from the end of the active cutting structure 1300 than the cutting blade end side 1318 of the gage pad 1310 by an axial distance D. A preferred axial distance D may range from 0 to 50 percent of the axial length L of the gage pad 1310. Further, other embodiments may have a stabilization pad axially located farther from the end of the active cutting structure than a gage pad, wherein the face-proximal side of a stabilization pad is disposed at an axial distance substantially equal to position of the blade-distal side of the gage pad.

The inventors of the present disclosure have advantageously found that the stabilization of a bit may be improved by positioning stabilization pads closer to the end of the active cutting structure. In particular, stabilization of a bit at the bottomhole of a borehole may be improved by positioning stabilization pads closer to the end of the active cutting structure. Thus, according to preferred embodiments, the axial position of stabilization pads may overlap with the axial position of gage pads to provide enhanced stabilization closer to the bottomhole.

Figure 14:
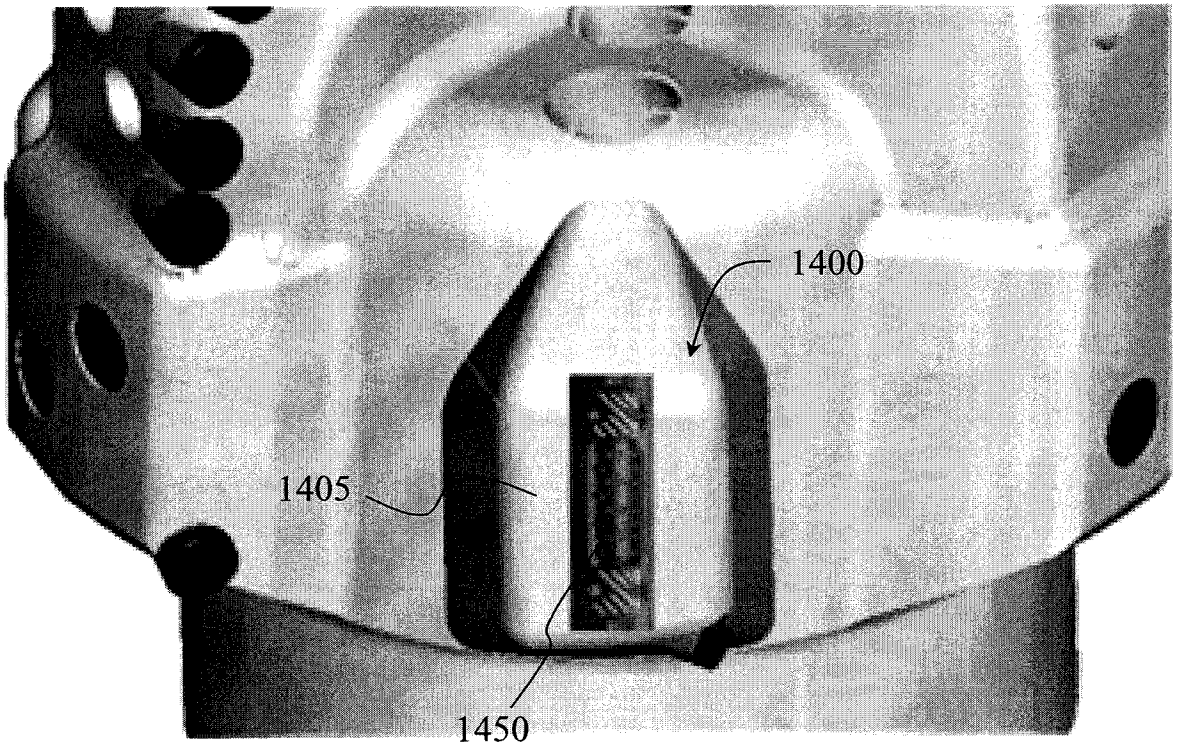
FIG. 14 shows a stabilization pad according to embodiments of the present disclosure.

Furthermore, stabilization pads of the present disclosure may have a friction-reducing surface. For example, stabilization pads of the present disclosure may have a coating of low-friction material, such as diamond. In some embodiments, as shown in FIG. 14, stabilization pads 1400 may have rollers 1450 on the top surface 1405 of the stabilization pad. The rollers 1450 may provide contact with the borehole, but with less friction. In particular, a roller 1450 may have an axis of rotation perpendicular with the direction of bit rotation so that as the bit rotates, the roller 1450 rotates in the opposite direction from the direction of bit rotation. As the roller 1450 contacts the borehole wall, the roller 1450 may rotate instead of drag along the borehole side wall, thus reducing the amount of friction. It is within the scope of this disclosure that other means of reducing friction between stabilization pads and the borehole wall may be used.

Generally, in rotary drill bits, a greater number of points of contacts between the outer diameter (i.e., gage) of the drill bit and the borehole may result in increased friction between the bit and borehole. Advantageously, drill bits according to the present disclosure have a decreased amount of points of contact between the drill bit gage and the borehole when compared with conventional PDC bits. In particular, drill bits according to the present disclosure may have a low blade count (e.g., between three and five blades), and thus, a low number of gage pads. Further, the stabilization pads of the present disclosure may have a smaller surface area contacting the borehole than prior art stabilization mechanisms. Thus, embodiments of the present disclosure provide a means of enhancing bit stability, while at the same time, minimizing friction between the bit and the borehole.

Embodiments of the present disclosure may also provide improved drill bits for horizontal drilling applications. During horizontal or lateral drilling, drill bits may have a tendency to drop, or veer away from the horizontal drilling path towards the direction of gravity. By providing stabilization pads of the present disclosure on bits drilling in horizontal drilling applications, the increased points of contact from the stabilization pads may decrease the amount of drop experienced by the bit. Thus, advantageously, embodiments of the present disclosure may directionally hold the bit from dropping, thus improving the efficiency and accuracy of the bit. Additionally, bits of the present disclosure may have improved stability and performance in curve drilling (i.e., drilling a curved path), such as transitioning from a vertical drilling path to a horizontal drilling path. In particular, while drilling the turn or the curve of a borehole path, stabilization pads according to the present disclosure may provide more points of contact, which may help to bear the aggressiveness of the curved drilling site.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A drill bit comprising:

a bit body having a rotational axis extending therethrough;

a plurality of cutting blades extending radially from the bit body and having cutting elements disposed thereon, the plurality of cutting blades forming a cutting blade gage pad diameter configured to contact a formation; and a plurality of raised volumes of material extending from the bit body and devoid of cutting elements, the plurality of raised volumes of material forming a gage pad diameter configured to contact the formation;

wherein at least a portion of the gage pad diameter defining regions of at least one of the plurality of cutting blades and at least a portion of at least one of the plurality of raised volumes have axial positions overlapping a single circumferential line around the rotational axis; and wherein the plurality of cutting blades and the plurality of raised volume of material are circumferentially spaced having fluid courses that extend therebetween.

2. The drill bit of claim 1, wherein the plurality of cutting blades and the plurality of raised volume of material are configured in an alternating arrangement about a center of the bit body.

3. The drill bit of claim 1, wherein the gage pad diameter of the raised volume of material is less than the cutting blade gage pad diameter.

4. The drill bit of claim 3, wherein the gage pad diameter of the raised volume of material is about 0.01 inches to about 0.15 inches less than the cutting blade gage pad diameter.

5. The drill bit of claim 1, wherein a gage pad extends axially into a gage region of the bit body from each of the plurality of cutting blades, wherein each gage pad has a gage surface, a cutter-proximal side, a blade end side, a leading side and a trailing side, and wherein each of the plurality of raised volume of material has a top surface, a face-proximal side, a face-distal side, a leading side, and a trailing side.

6. The drill bit of claim 5, wherein the face-proximal side of each of the raised volume of material is disposed axially between the cutter-proximal side and the blade end side of the gage pads.

7. The drill bit of claim 5, wherein the arc length distance between the leading side of at least one of the raised volumes of material and the trailing side of an adjacent gage pad is equal to the arc length distance between the trailing side of the at least one raised volume of material and the leading side of another adjacent gage pad.

8. The drill bit of claim 5, wherein the arc length distance between the leading side of at least one of the raised volumes of material and the trailing side of an adjacent gage pad is less than the arc length distance between the trailing side of the at least one raised volume of material and the leading side of another adjacent gage pad.

9. The drill bit of claim 5, wherein the arc length distance between the leading side of at least one of the raised volumes of material and the trailing side of an adjacent gage pad is greater than the arc length distance between the trailing side of the at least one raised volume of material and the leading side of another adjacent gage pad.

10. The drill bit of claim 5, wherein each raised volume of material comprises less than 25 percent of the arc length between a pair of adjacent gage pads.

11. The drill bit of claim 1, wherein the drill bit comprises at least two and less than five cutting blades.

12. The drill bit of claim 1, wherein at least one of the raised volumes of material has a roller that contacts the formation.

13. A drill bit comprising:

a bit body having a face, a gage region, and a rotational axis extending therethrough;

a plurality of cutting blades extending radially from the rotational axis and extending axially from the face to the gage region, the plurality of cutting blades comprising cutting elements disposed thereon;

a plurality of gage pads extending axially into the gage region from the plurality of cutting blades, wherein each gage pad has a gage surface defining a gage diameter, a cutter-proximal side, a blade end side, a leading side and a trailing side;

at least one stabilization pad, each stabilization pad having a top surface defining a gage diameter, a face-proximal side, a face-distal side, a leading side, and a trailing side;

wherein each top surface of the stabilization pad is disposed circumferentially about the bit body in the gage region between a pair of gage surfaces of adjacent gage pads, and wherein at least a portion of the top surface of at least one stabilization pad and at least a portion of at least one of the adjacent gage pads have axial positions overlapping circumferential line around the rotational axis; and wherein each stabilization pad comprises less than 50 percent of the arc length between the pair of adjacent gage pads;

wherein the drill bit comprises at least two and less than five blades.

14. The drill bit of claim 13, wherein the face-proximal side of the at least one stabilization pad is disposed axially between the cutter-proximal side and the blade end side of the gage pads.

15. The drill bit of claim 13, wherein the arc length distance between the leading side of the stabilization pad and the trailing side of one of the pair of adjacent gage pads is equal to the are length distance between the trailing side of the stabilization pad and the leading side of the other of the pair of adjacent gage pads.

16. The drill bit of claim 13, wherein the arc length distance between the leading side of the stabilization pad and the trailing side of one of the pair of adjacent gage pads is less than the arc length distance between the trailing side of the stabilization pad and the leading side of the other of the pair of adjacent gage pads.

17. The drill bit of claim 13, wherein the arc length distance between the leading side of the stabilization pad and the trailing side of one of the pair of adjacent gage pads is greater than the arc length distance between the trailing side of the stabilization pad and the leading side of the other of the pair of adjacent gage pads.

18. The drill bit of claim 13, wherein the radial height from the bit body surface to the gage surface is equal to the radial height from the bit body surface to the top surface of the at least one stabilization pad;

wherein the entire gage surface of each gage pad and the entire top surface of each stabilization pad is at gage.

19. The drill bit of claim 13, wherein the radial height from the bit body surface to the top surface of the at least one stabilization pad is less than the radial height from the bit body surface to the gage surface of each gage pad, wherein the entire gage surface of each gage pad is at gage; and wherein the entire top surface of each stabilization pad is at less than gage.

20. The drill bit of claim 13, wherein the radial height of the top surface of the at least one stabilization pad tapers from gage to a distance less than gage.

21. The drill bit of claim 20, wherein the radial height of the top surface at the face-proximal side of the at least one stabilization pad is at gage and the radial height of the top surface at the face-distal side of the at least one stabilization pad is at the distance less than gage, and wherein the radial height tapers at a substantially constant rate from the face-proximal side to the face-distal side.

22. The drill bit of claim 13, wherein each stabilization pad comprises less than 25 percent of the arc length between the pair of adjacent gage pads.

23. The drill bit of claim 13, wherein at least one stabilization pad has a roller disposed in the top surface.

* * * * *